US006763926B2

(12) United States Patent
Miglioranza

(10) Patent No.: US 6,763,926 B2
(45) Date of Patent: Jul. 20, 2004

(54) METHOD AND APPARATUS FOR AUTOMATIC FEEDING OF BAR FORM METAL PROFILES IN PROFILE WORKING MACHINES

(75) Inventor: Aronne Miglioranza, Vicolo Fornace (IT)

(73) Assignee: Schnell S.p.A., Rosciano di Fano (IT)

( * ) Notice: Subject to any disclaimer, the term of this patent is extended or adjusted under 35 U.S.C. 154(b) by 0 days.

(21) Appl. No.: 10/353,985

(22) Filed: Jan. 30, 2003

(65) Prior Publication Data

US 2003/0201149 A1 Oct. 30, 2003

(30) Foreign Application Priority Data

Apr. 26, 2002 (IT) ..... BO2002A0241

(51) Int. Cl.[7] ..... B65G 47/10

(52) U.S. Cl. ..... 198/369.1; 198/467.1; 198/418; 198/468.2; 198/468.5; 414/745.7; 414/746.1

(58) Field of Search ..... 198/369.1, 468.5, 198/468.2, 467.1, 418; 414/745.7, 746.1

(56) References Cited

U.S. PATENT DOCUMENTS 2,959,268 A * 11/1960 McConnell ..... 198/467.1
3,340,850 A * 9/1967 Elliott ..... 198/418
6,287,066 B1 * 9/2001 Heinz et al. ..... 198/468.2

* cited by examiner

*Primary Examiner*—Joseph E. Valenza
(74) *Attorney, Agent, or Firm*—Guido Modiano; Albert Josif; Daniel O'Byrne

(57) ABSTRACT

A method for feeding automatically metal profiles in bar form entails gripping a group of the metal profiles from a magazine for collecting the profiles and transferring the group of metal profiles or their end to a raised position. The raised metal profiles are arranged on a movable transfer device provided with means for separating the metal profiles, at which the initial portion of a preset number of metal profiles to be fed to the machine at each work cycle is conveyed transversely and counted. The metal profiles are transferred, in the counted number, at receiving elements of the machine, while the excess metal profiles are unloaded inside the collection magazine.

22 Claims, 30 Drawing Sheets

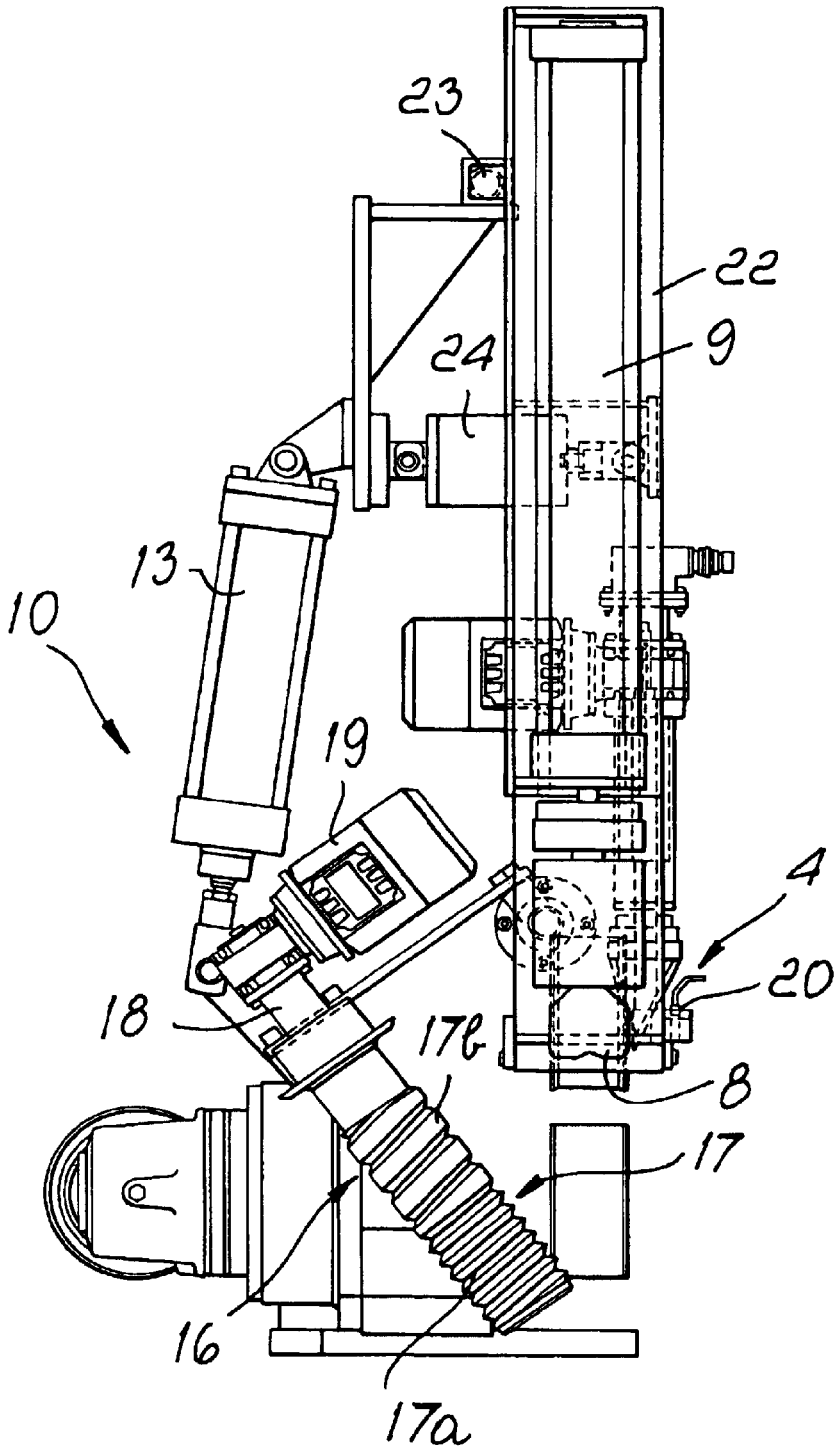
Fig. 21
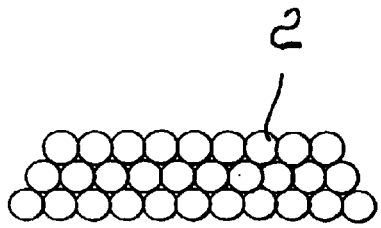

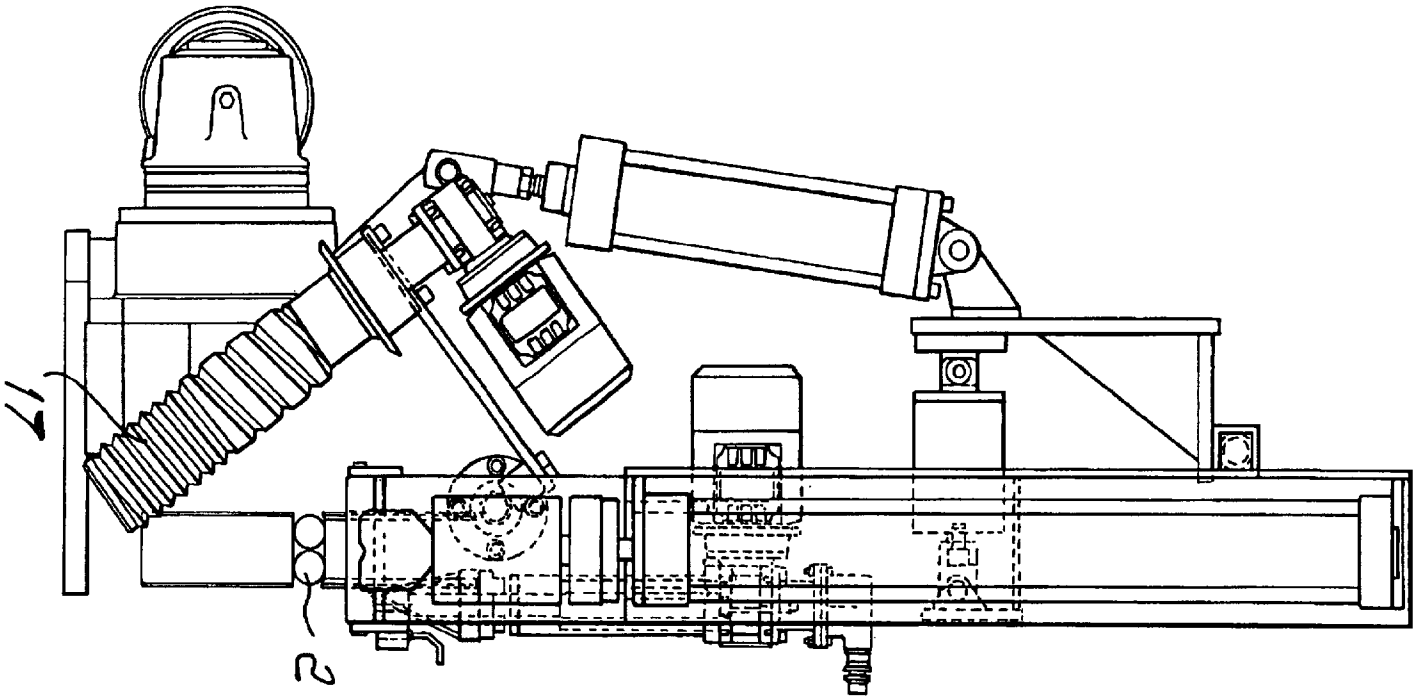
Fig. 28
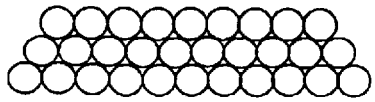

METHOD AND APPARATUS FOR AUTOMATIC FEEDING OF BAR FORM METAL PROFILES IN PROFILE WORKING MACHINES

BACKGROUND OF THE INVENTION

The present invention relates to a method and an apparatus for feeding automatically metal profiles in bar form, particularly iron rods for reinforced concrete, in machines for working said profiles.

It is known that the rods used, for example, to produce reinforcement frames for reinforced concrete can be obtained from iron rods in bar form. For this purpose, the bars are fed, individually or in groups, to machines that work them automatically into a series of intended products. The machines provide, if required, a suitable series of processes, in particular cropping the rods to size.

The bars are currently fed to said machines manually by an operator, who counts and picks up the initial portion of a group of bars from a collection magazine, also known as stock magazine, which is arranged in line with the machine, and inserts said bars through an inlet of the working components of the machine. The operator then starts the working cycle of the machine, which automatically draws the bars into the head, measures them, bends them if required, and crops them according to a program provided for this purpose.

Feeding the bars is particularly difficult for the operator, who is forced to work in a very noisy and potentially dangerous environment. The difficulty is further increased by the fact that said bar feeding must be performed relatively frequently. The bars in fact have a limited length, which leads to an equally limited, working time, due to the operating speed of the machine, and therefore leads to the need to feed the machine frequently.

It should also be noted that during this feeding step it is also necessary to determine the correct number of bars to be fed to the machine according to the working requirements. For example, the number of bars to be fed to the cutting elements of the machine is determined, in relation to the working capacity of said components, by the diameter of said bars, by the characteristics of the material being worked and by production requirements.

Italian patent no. 1,206,893 describes a device for feeding the profiles to a machine tool which comprises an opening in the upper part and a horizontal roller that is arranged in a fixed position below said transport opening, is provided with a helical groove and is associated with a transfer disk that has radial notches. The bundles of profiles are fed to the transport roller by virtue of suitable collet-type pick-up means, which must move the end of the bundle so as to move around the entire structure so as to reach the upper part where the opening is located. The transport roller and the transfer disk are motorized synchronously, so, as to produce the translational motion of profiles that rest tangentially at the helical groove and the subsequent transfer of the individual profiles, by virtue of said radial notches, to the machine tool.

Said feeder, however, is scarcely functional and not very versatile. The horizontal roller in fact picks up the, bars from the bundle picked up by virtue of said collet means starting from the bottom of the bundle placed in the inlet, where the bars are most entangled and are surmounted by the mass of the bundle. This makes traction difficult for the transport elements, owing to the higher friction that occurs between the contact surfaces, since the surfaces of the bars are normally ribbed. Moreover, changing from one type of work to another, for example to change bar length or diameter, is very complicated, because in order to be able, to move the machine with respect to the various storage units of the stock magazine it is necessary to clear the device of the residual bars, and this operation is not straightforward.

SUMMARY OF THE INVENTION

The aim of the present invention is to solve the cited problem by providing a method that allows to feed automatically the metal profiles in bar form in machines for working said profiles and to clear said machine immediately, so as to allow it to move immediately at the end of each working cycle.

Within the scope of this aim, an object of the present invention is to provide a method that allows to determine the correct number of profiles to be fed to the machine as a function of work requirements.

Another object of the invention is to provide an apparatus that allows to provide said method by means of a structure that is simple in concept, safety reliable in operation, versatile in use, low in cost and possibly applicable to existing machines with minimal modifications.

This aim and these and other objects are achieved, according to the present invention, by the method for feeding automatically metal profiles in bar form in machines for working said profiles, which is characterized in that it comprises the steps of:

(a). gripping a group of metal profiles in bar form or their end from a magazine for collecting said profiles;

(b). transferring said group of metal profiles in bar form or their end to a raised position;

(c). arranging under said metal profiles in bar form a transfer device provided with means for separating said profiles;

(d). transferring transversely said metal profiles in bar form and at the same time counting a preset number of metal profiles to be fed to the machine at each work cycle;

(e). unloading the excess metal profiles into the same magazine from which they originate;

(f). starting automatically the normal work cycle of the machine to perform the intended work on the selected metal profiles;

(g). optionally moving with respect to each other the machine and said collection magazine in order to pick up metal profiles from a different storage unit;

(h). starting an optional new work cycle by resuming from step (a).

BRIEF DESCRIPTION OF THE DRAWINGS

The details of the invention will become better apparent from the detailed description of a preferred embodiment of the apparatus for feeding automatically metal profiles in bar form in machines for working said profiles, illustrated only by way of non-limitative example in the accompanying drawings, wherein:

FIGS. 21, 22, 23, 24, 25, 26, 27 and 28 are front views of said apparatus in said successive steps of operation;

DESCRIPTION OF THE PREFERRED EMBODIMENTS

Figure 1:
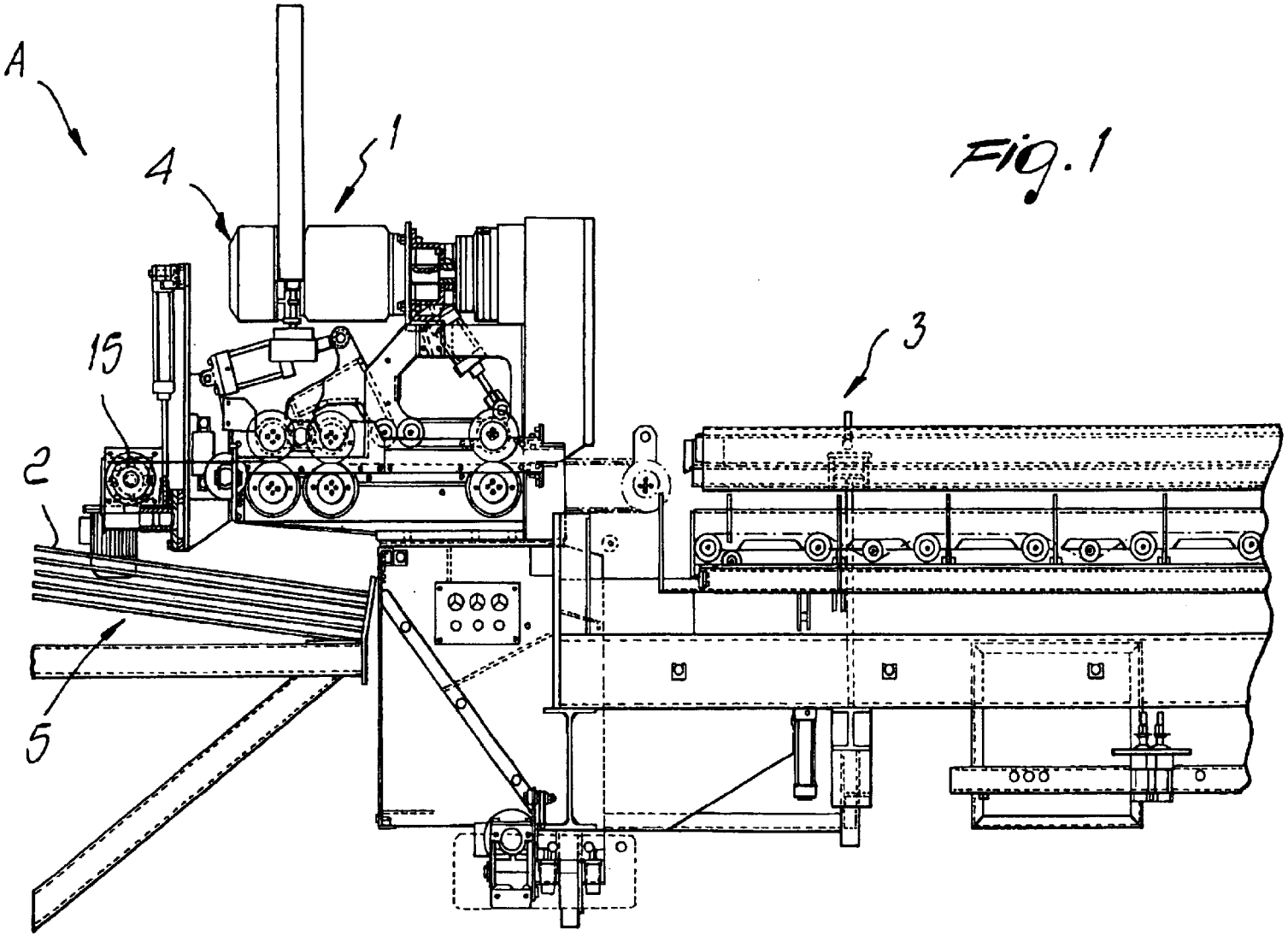
FIG. 1 is a side view of a machine provided with the apparatus for feeding automatically the metal profiles in bar form according to the method of the invention.

With particular reference to the figures cited above, the reference numeral 1 generally designates the apparatus for feeding automatically the metal profiles 2 in bar form in a machine for working said profiles, for example a cutting table 3 of a known type. The figures show only the front end of the bars 2.

The apparatus 1 is provided with means 4 for gripping the end of a group of bars 2 from a magazine 5 for collecting said bars 2, also known as stock magazine, which is arranged in line with the machine 3. More particularly, the end region of the collection magazine 5 is arranged at the inlet region of the machine and faces an opening 6 for accessing the working components 7, which is suitable to receive the bars 2 to be worked. The magazine 5 can be movable with respect to the machine, in a known manner, in order to feed said machine with bars of a different kind according to the work that is required; as an alternative, the machine can be moved with respect to the stock magazine in order to select the bars 2 to be worked.

The grip means 4 are conveniently constituted by a permanent magnet 8, which is moved along a vertical axis by an actuator 9, for example a jack.

As an alternative, the magnet 8 can follow a particular path that is defined according to the physical dimensions of the cutting head and of the stock magazine compartment, or to allow the same mutual arrangement of the machine with respect to the stock magazine that said machine would assume without the apparatus according to the invention.

Naturally, it is possible to use grip means of a different kind, for example an electromagnet or a collet-like element.

Figure 8:
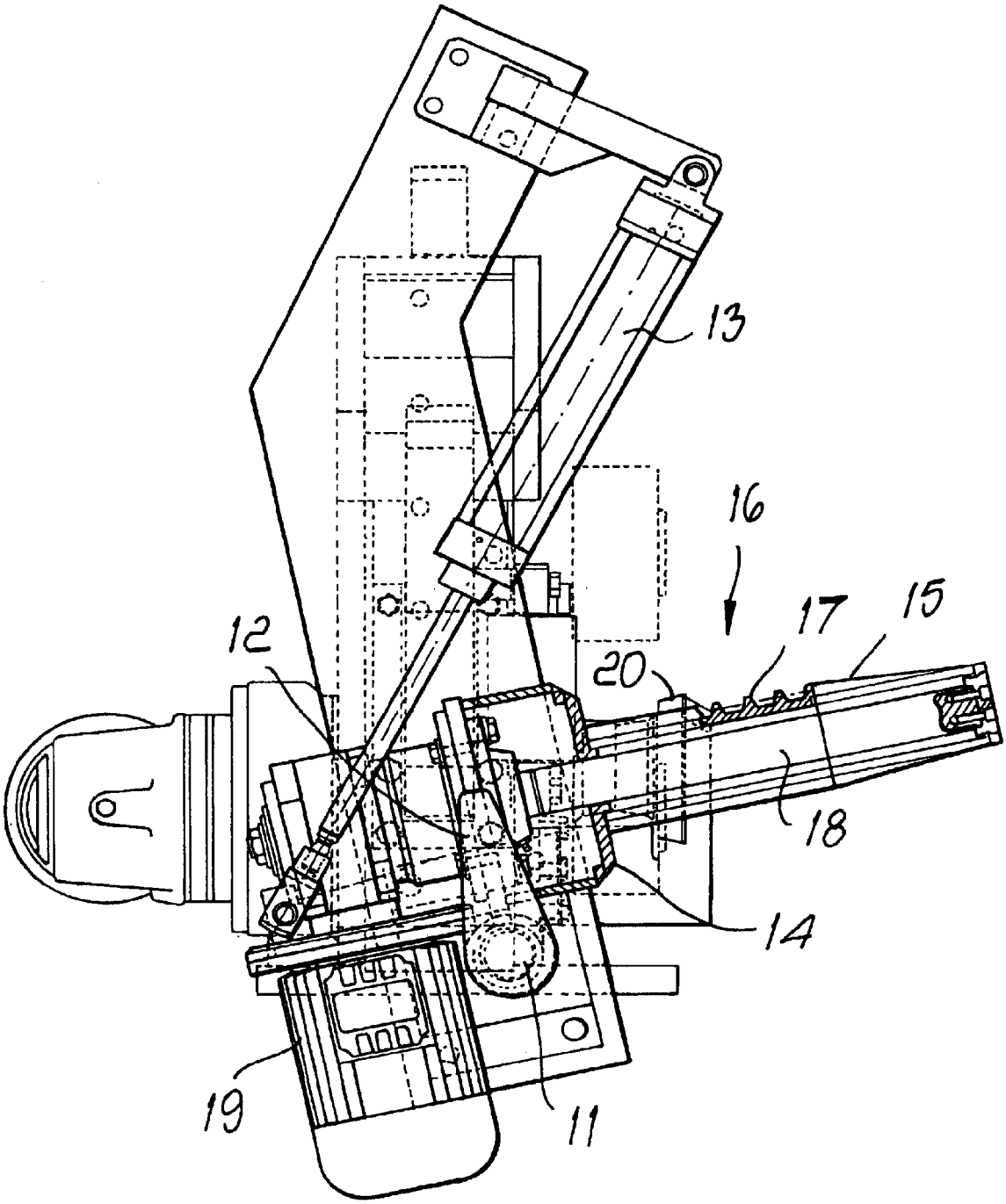
FIG. 8 is a detail view of the apparatus in the step shown in FIG. 7.

The grip means 4 are suitable to cooperate with a transfer device 10 arranged above the collection magazine 5. The transfer device 10 can oscillate about a horizontal axis 11 by virtue of a crank system 12 actuated by an actuator 13, for example a jack (see in particular FIG. 8).

The transfer device 10 has a body 14, which forms a ledge 15 that defines a transfer surface for the bars 2, at which a separator 16 for separating said bars 2 acts; said separator is constituted for example by a screw feeder 17, which is mounted so that it can rotate on a shaft 18 suitable to be turned by a motor 19 supported by the body 14.

Means 20 for counting the bars 2 cooperate with the screw feeder 17 and are for example of the type that comprises a microswitch or is constituted by optical sensor means of the photocell type, by mechanical means, laser means or the like.

The ledge 15 that supports the screw feeder 17 can rotate, under the actuation of the actuator 13, through an arc of substantially approximately 90°, between a substantially horizontal raised position, which is slightly inclined toward the opening 6, and a substantially vertical lowered position, in order to avoid hindering the passage of the bars during the movement for loading them.

The method for feeding automatically the metal profiles 2 in bar form essentially entails gripping, from a bundle, a group of bars 2, preferably the uppermost ones, from the collection magazine 5 by means of the magnet 8 of the grip means 4 and transferring said group of bars 2 to a raised position.

Figure 2:
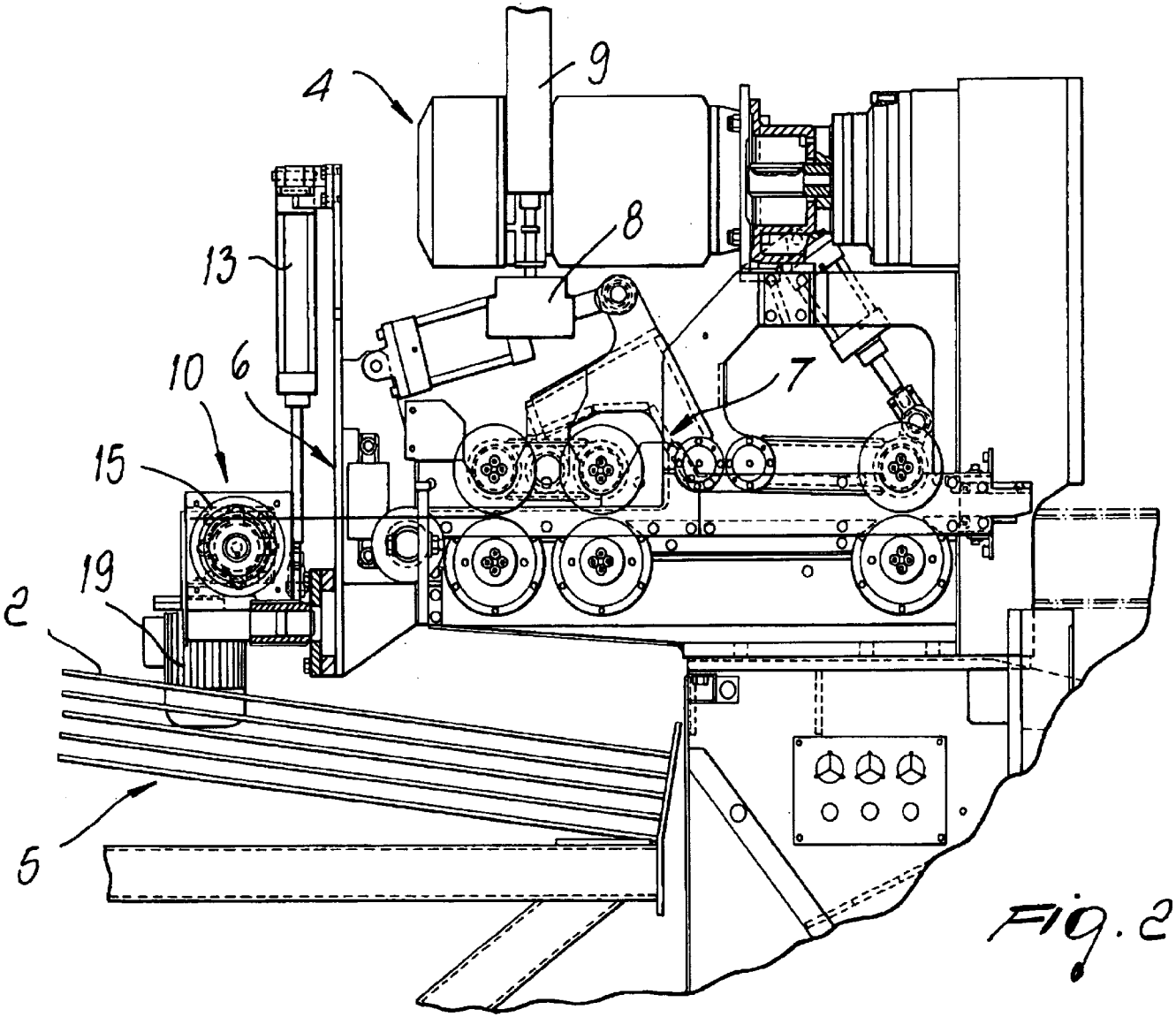
FIG. 2 is an enlarged-scale view of the region of the machine that is affected by the apparatus according to the invention, which is designated by the reference letter A in FIG. 1.
Figure 3:
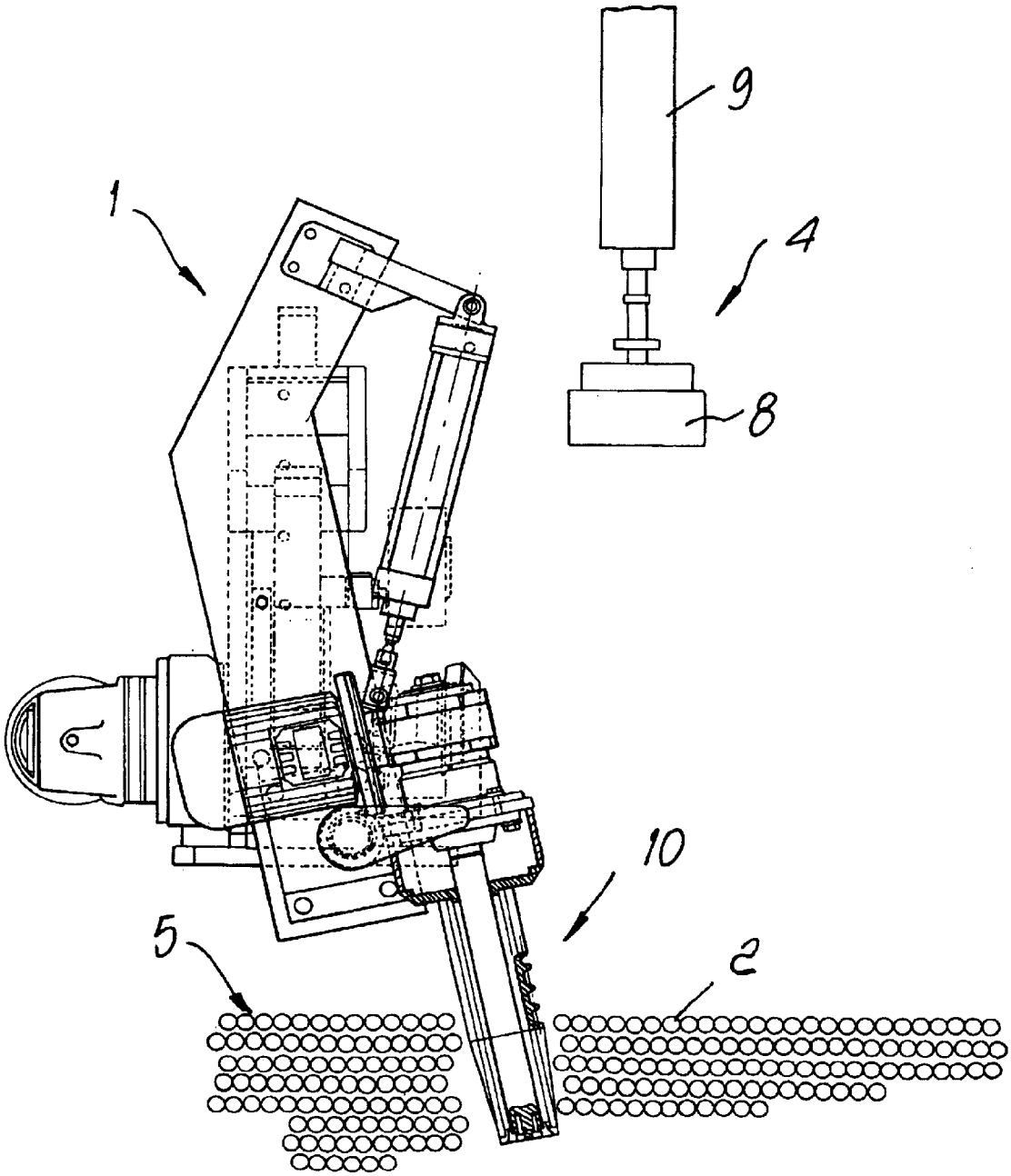
FIG. 3 is a schematic front view of said apparatus.
Figure 4:
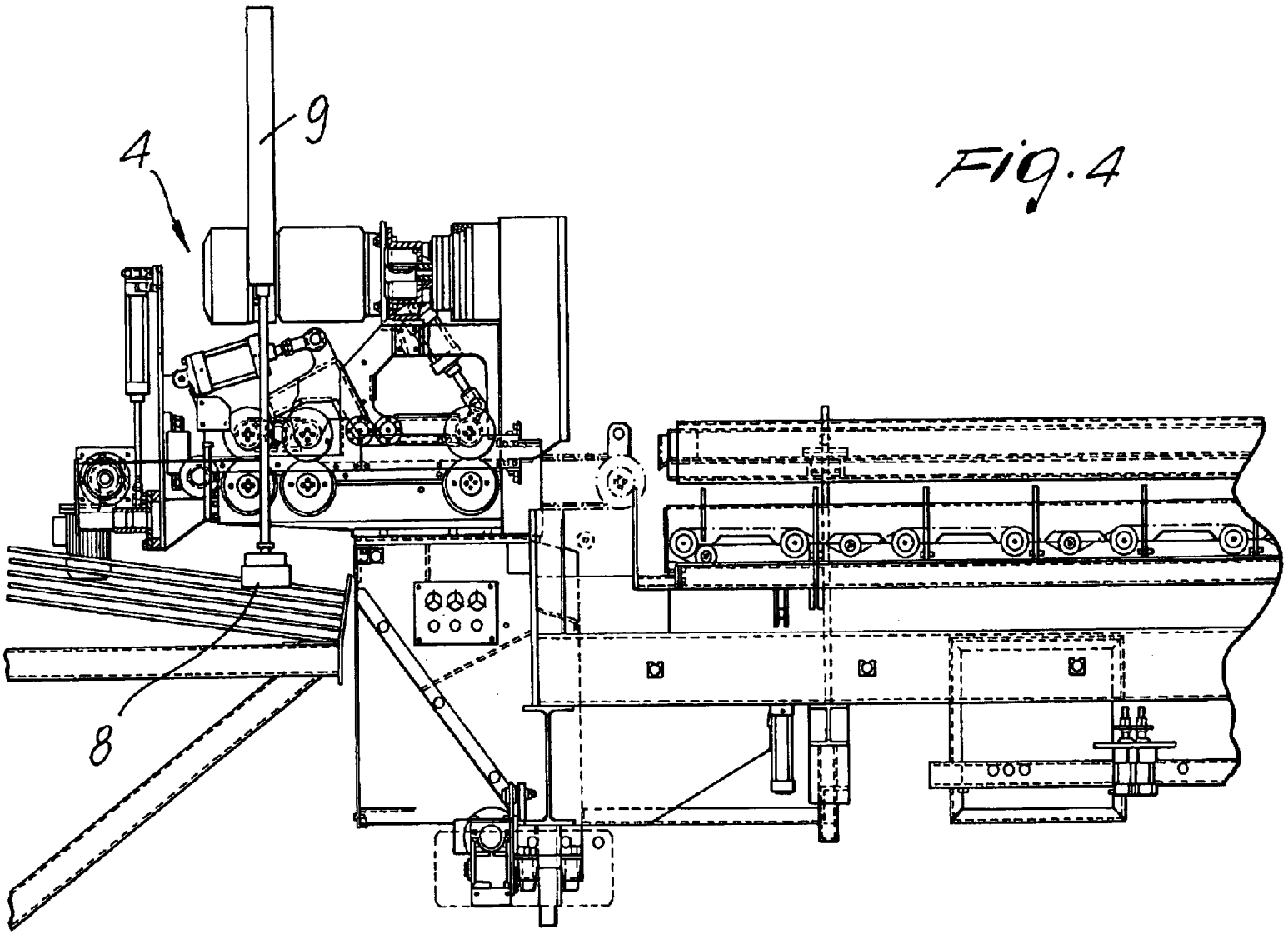
FIGS. 4, 5 and 6, 7 are side and front views of successive steps of the operation-of the apparatus.
Figure 5:
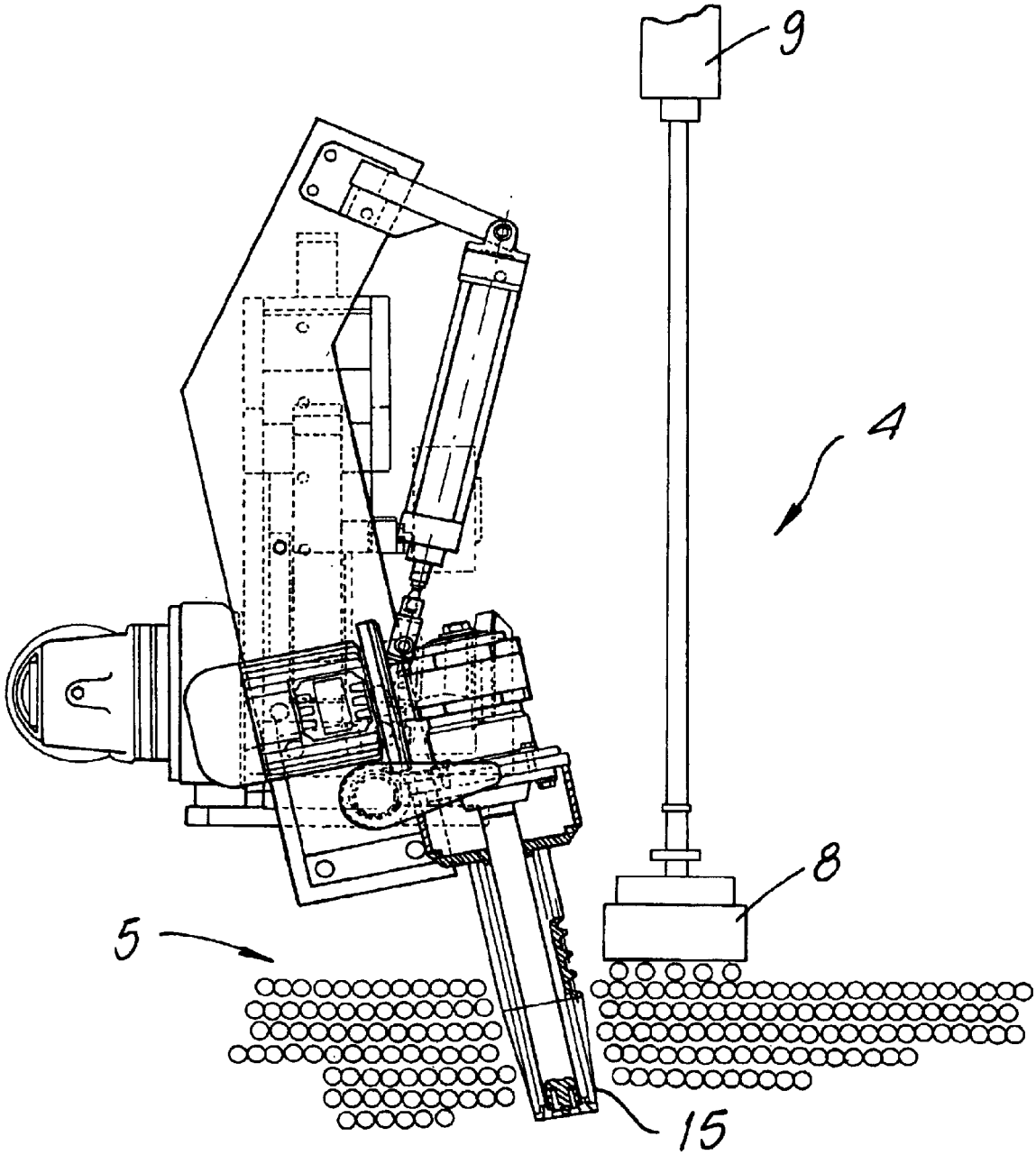

For this purpose, the grip magnet 8 is actuated so as to move from a raised inactive position (see FIGS. 1, 2 and 3) to a lowered grip position against the bundle of bars 2, thus making contact with the bars that lie in the uppermost part of the bundle, at the collection magazine 5 (FIGS. 4 and 5). The magnet 8 grips the bars 2 proximate to their initial portion along the subsequent direction of advancement inside the machine. It should be noted that during this step for picking up the bars 2 the screw feeder 17 of the transfer device 10 is rotated into the substantially vertical lowered position, i.e., in a configuration that clears the bar passage.

Figure 6:
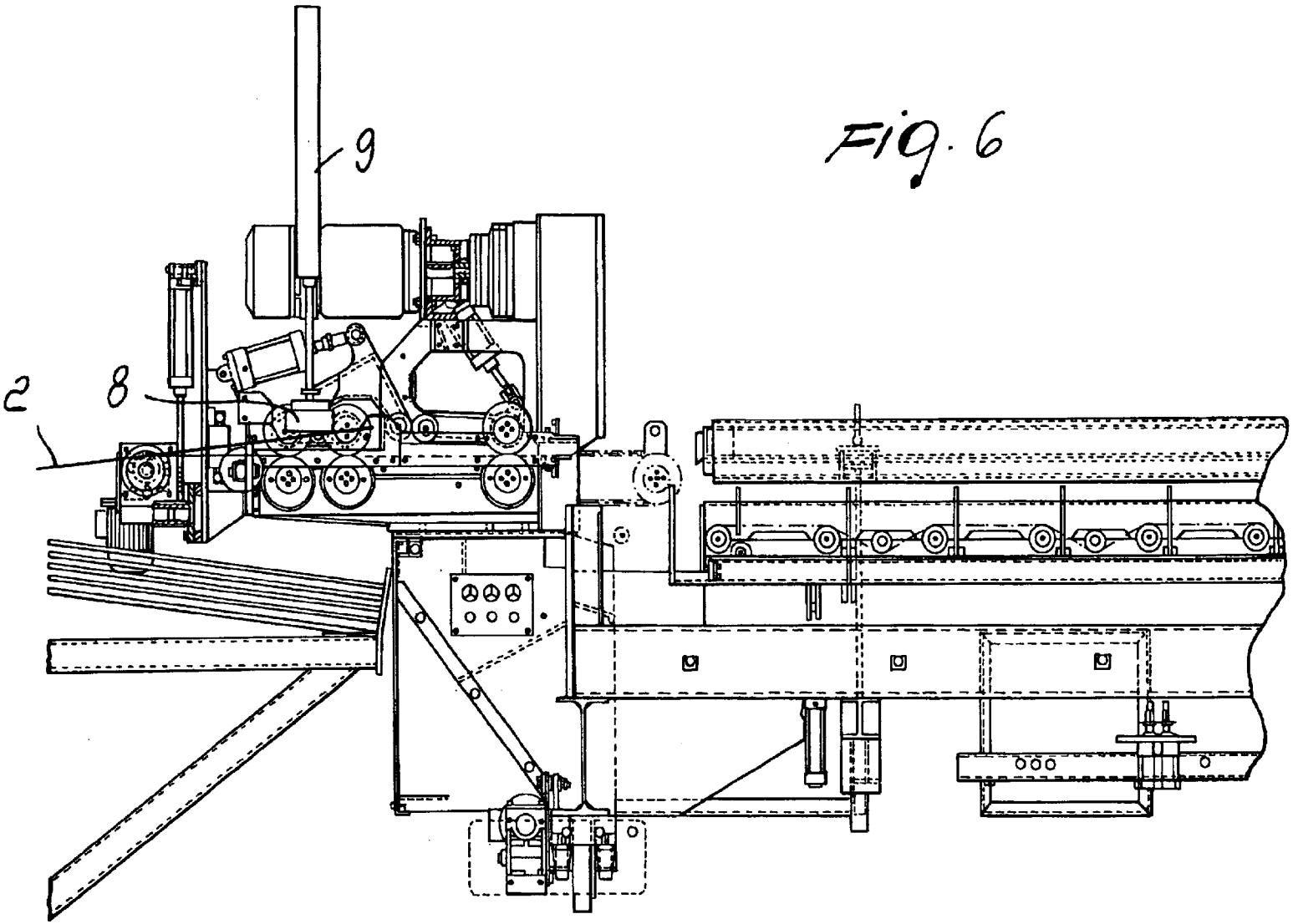
Figure 7:
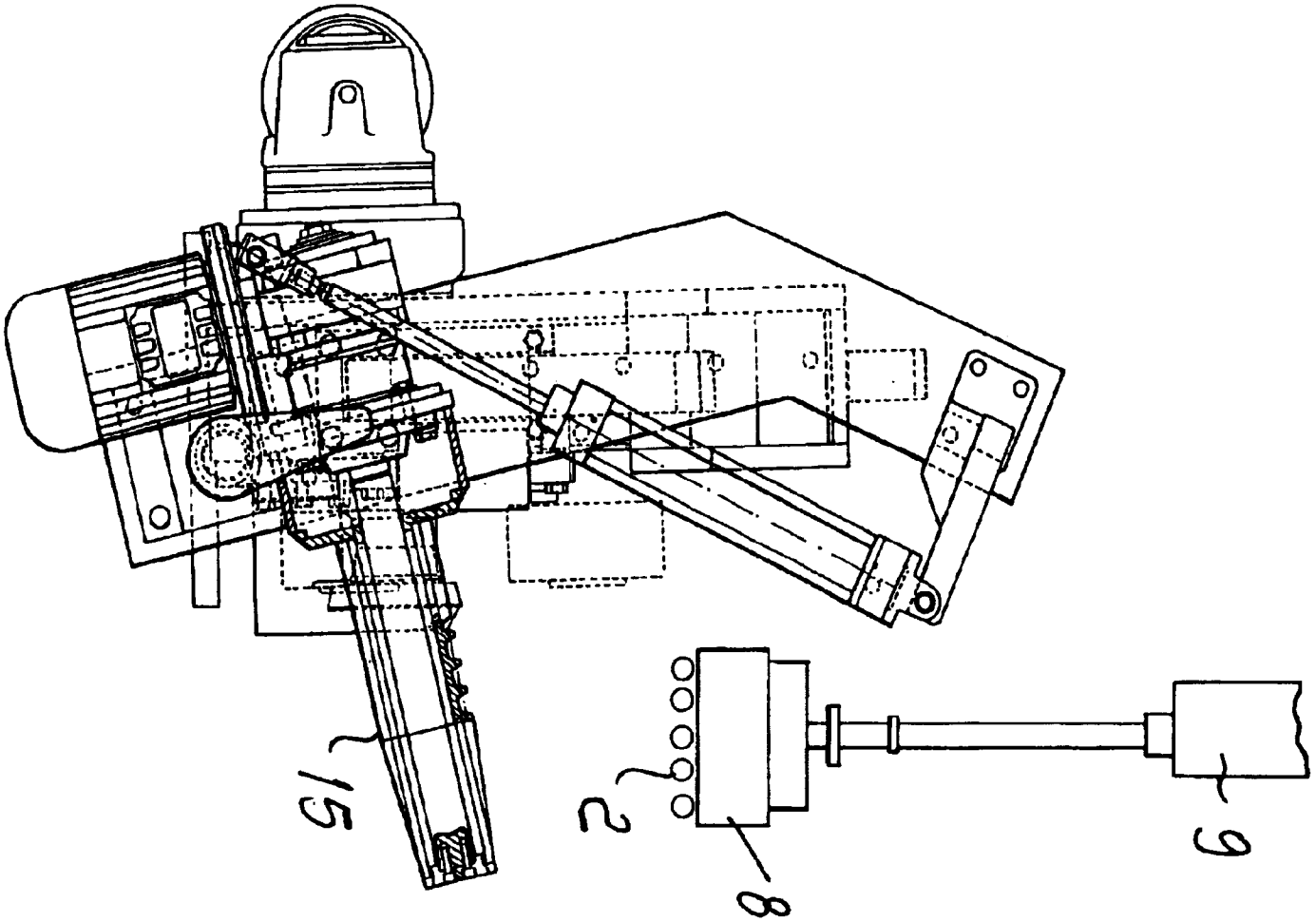

After gripping said group of bars 2, the grip magnet 8 is again moved vertically in order to place in a raised position the group of bars 2 that remain attached to it (FIGS. 6 and 7).

Suitably in step with said movement for lifting said group of bars, the angular rotation of the ledge 15 with the screw feeder 17 of the transfer device 10 into the substantially horizontal raised position is actuated.

The magnet 8 continues its upward stroke, carrying with it the bars 2, which encounter suitable mechanical abutment means, described in greater detail hereinafter, or a fixed mechanical abutment in order to separate the bars 2. If an electromagnet is used, it can act, in this step, as a presser to avoid the overlap of the bars 2 (see FIG. 10). Otherwise, the magnet 8 is raised and the function of preventing the bars 2 from being inserted while resting on each other is performed likewise by an appropriately provided element 21 that is suitable for the purpose.

Figure 9:
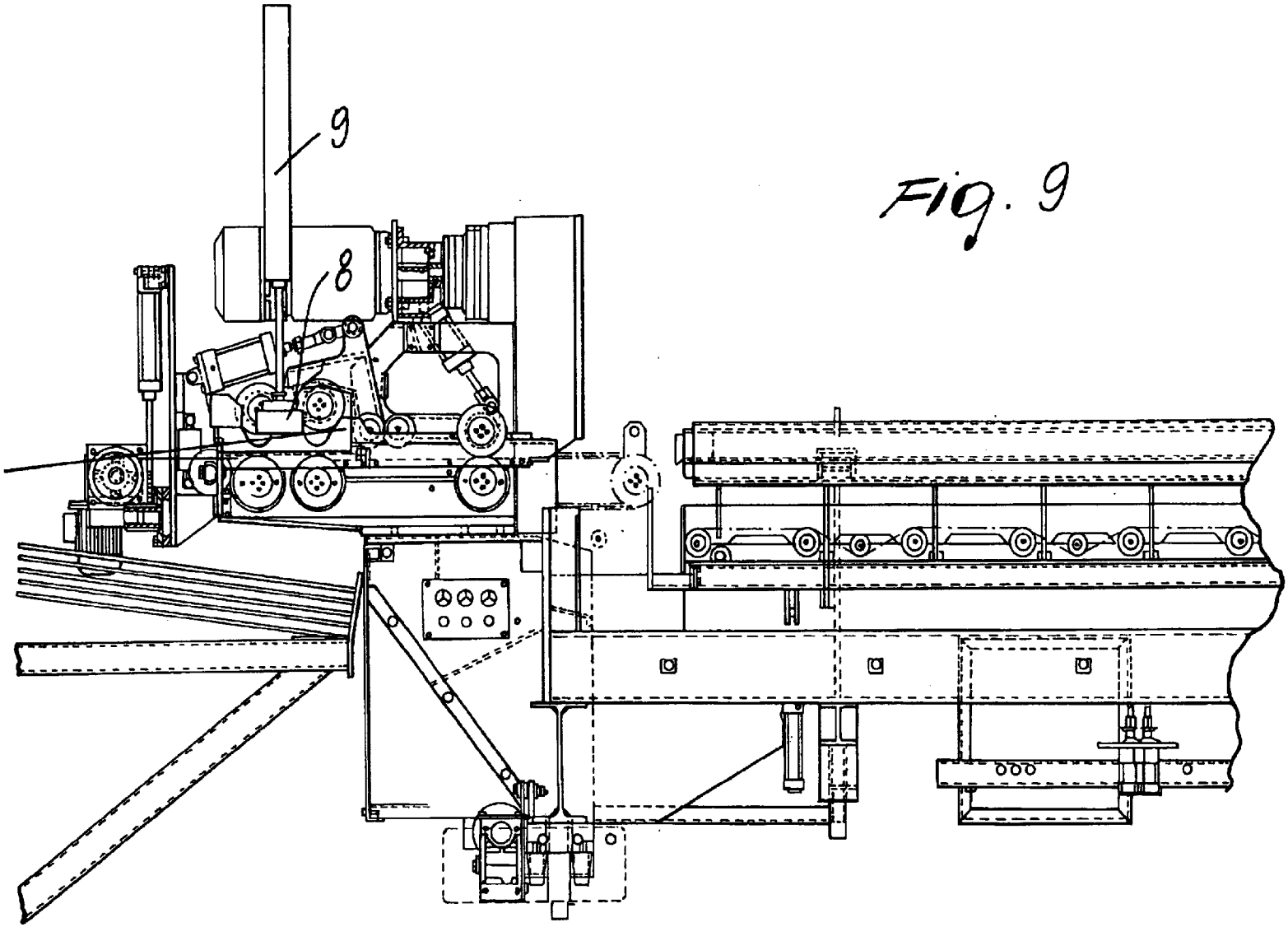
FIGS. 9, 10 and 11, 12, 13 are side and front views of additional steps of the operation of the apparatus.
Figure 10:
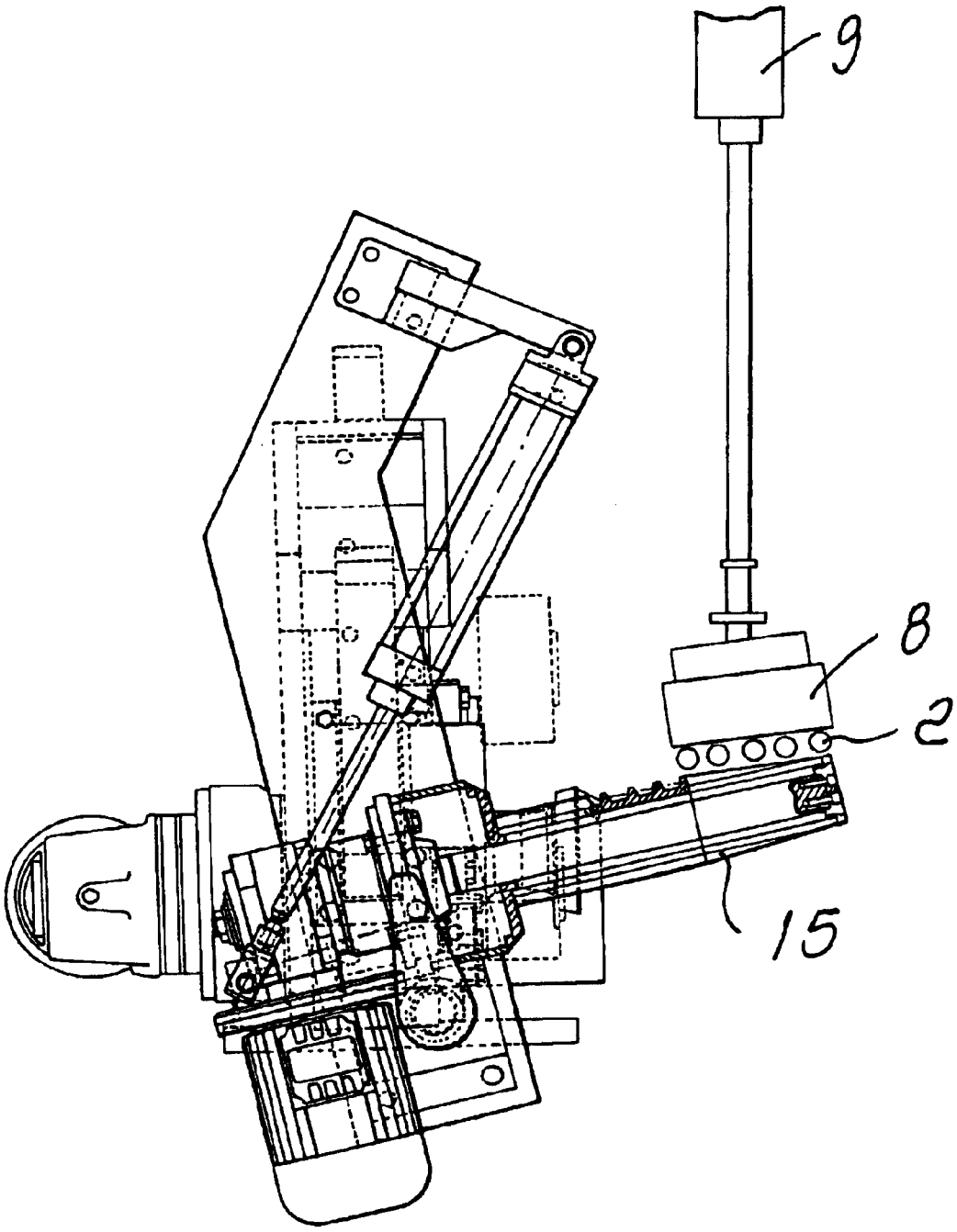

As an alternative, the grip means 8 open in order to deposit the picked group of bars 2, or by way of appropriate release control if the grip means 4 are constituted by an electromagnet, on the transfer surface formed by the ledge 15, which is preferably slightly inclined toward the opening 6 for accessing the working components of the machine (FIGS. 9 and 10).

Figure 11:
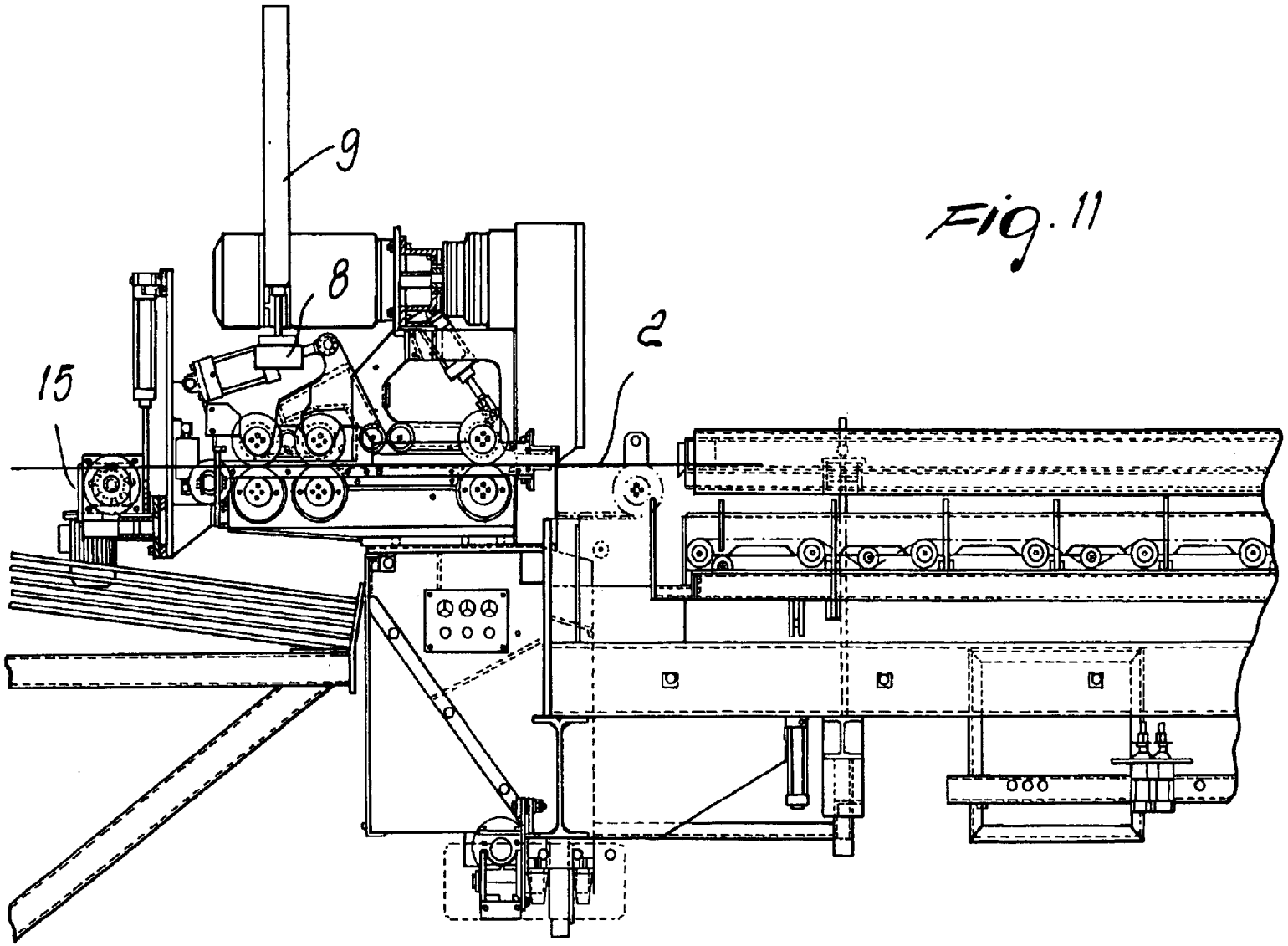
Figure 12:
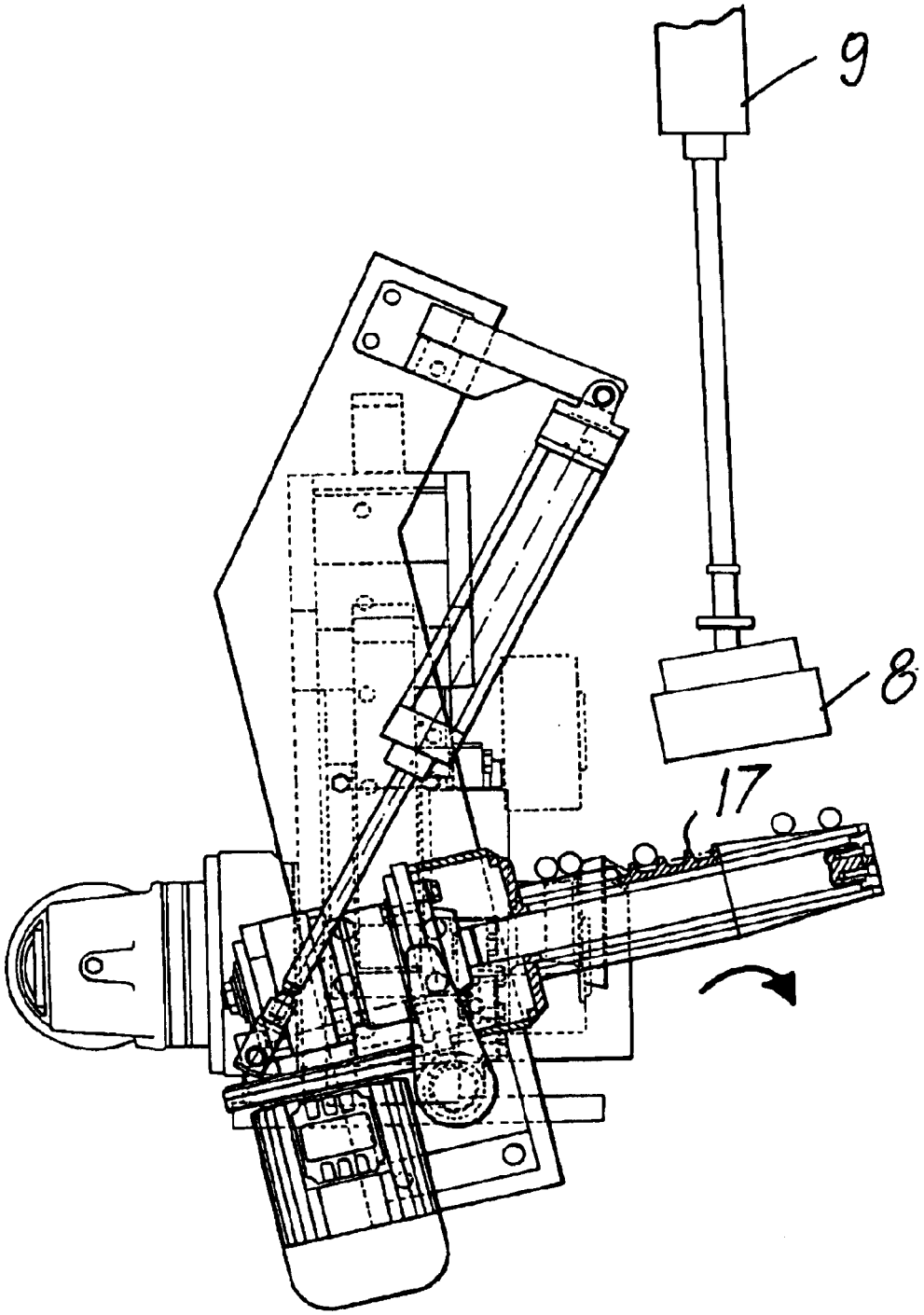

In this position, the screw feeder 17 is actuated so as to rotate. The bars 2 individually engage the compartments formed by the helix of the screw feeder 17, so that the screw feeder 17 transfers transversely, with uniform spacing, the individual initial portions of the bars 2 to be fed to the machine (FIGS. 11 and 12).

During said transverse transfer step, the bars 2 are also counted, for example by way of the counting means 20; said counting is conveniently controlled by appropriately provided electronic means and occurs according to the working capacity of the machine and/or to production requirements. The counted bars are already inserted in the grip elements 7.

Figure 13:
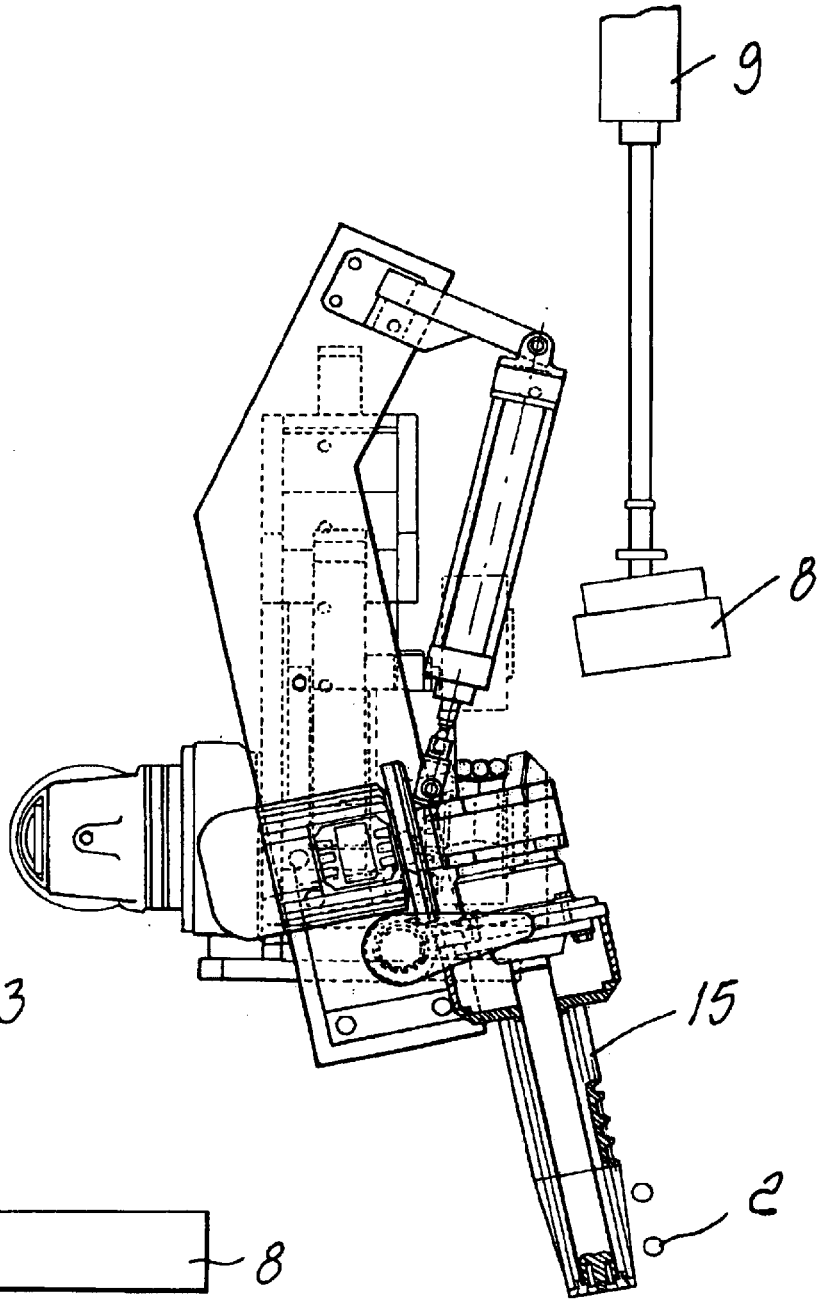

When a preset number of bars 2 to be fed to the machine is reached, the movement of the screw feeder 17 is halted. At this point, any intervention of a separation element 30 ensures that the number of counted bars no longer changes. Then the rotation of the ledge 15 of the transfer device 10 into the substantially vertical lowered position is actuated in order to unload the excess bars 2 into said collection magazine 5 (FIG. 13).

If instead the bars 2 that have been picked up are not sufficient to reach the preset number, the described cycle can be repeated until said number is reached.

Figure 14:
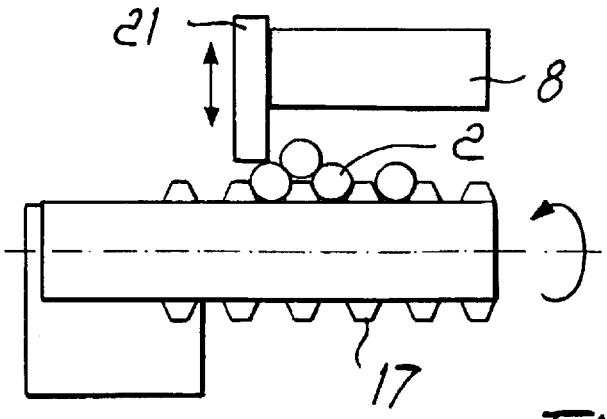
FIG. 14 is a front view of a detail of the transfer device of the apparatus according to the invention.
Figure 15:
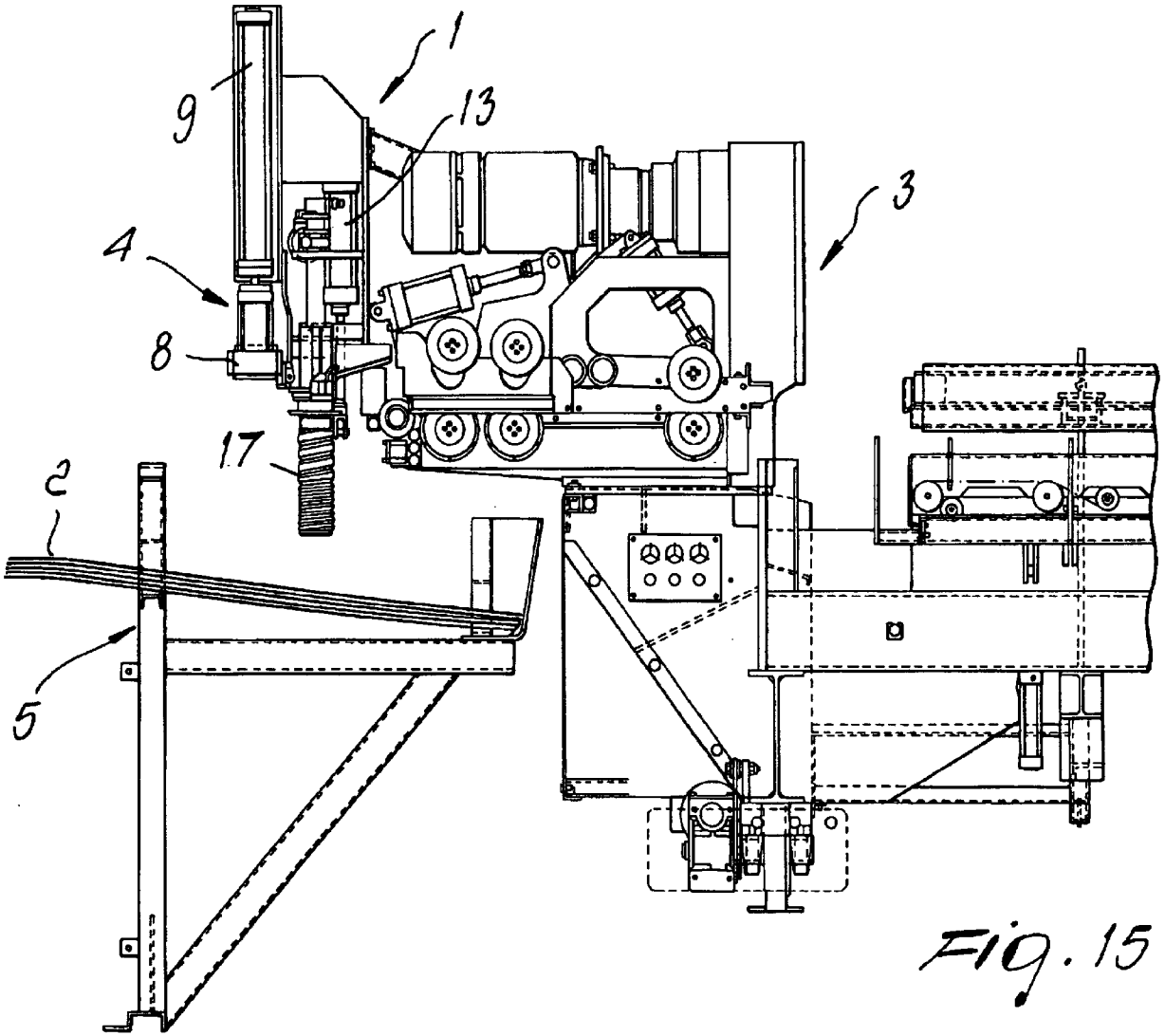
FIGS. 15, 16, 17, 18, 19 and 20 illustrate, in side views of the machine, a preferred embodiment of the apparatus according to the invention in successive steps of operation.

It is possible to associate conveniently an abutment 21 that is suitable to prevent the screw feeder 17 from conveying overlapping bars 2 (FIG. 14). The abutment 21 is in fact designed so as to allow the transfer only of the bars 2 that lie directly in contact with the screw feeder 17, while any overlapping bars are stopped outside the loading region to make them fall into a region of the screw feeder that is free from other bars, so that they can optionally be loaded and counted correctly by the counting means 20. The abutment 21 avoids the risk of introducing in the machine overlapping bars that might not be counted and might exceed the maximum working capacity of the machine, with possible irregularities in the transport of said bars.

The position of the abutment 21 can be adjusted conveniently in a vertical direction in order to act correctly with bars 2 having different diameters.

FIGS. 15–20 and 21–28 illustrate a preferred embodiment of the apparatus, in which the screw feeder 17 has a variable pitch and more specifically has two portions 17*a*, 17*b* with differentiated pitch. The first portion 17*a* has a short pitch, while the second portion 17*b* has an elongated pitch.

Figure 16:
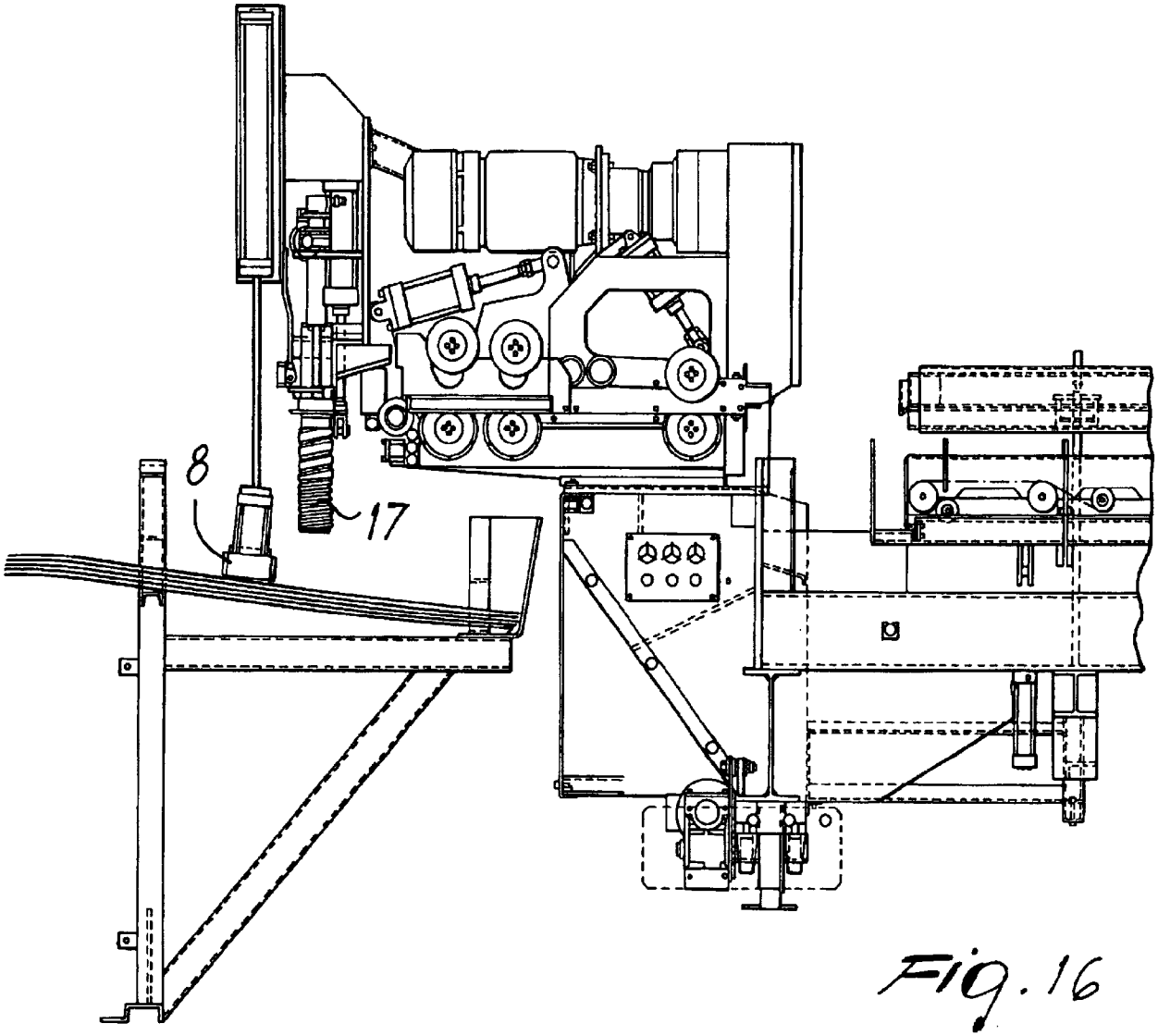
Figure 22:
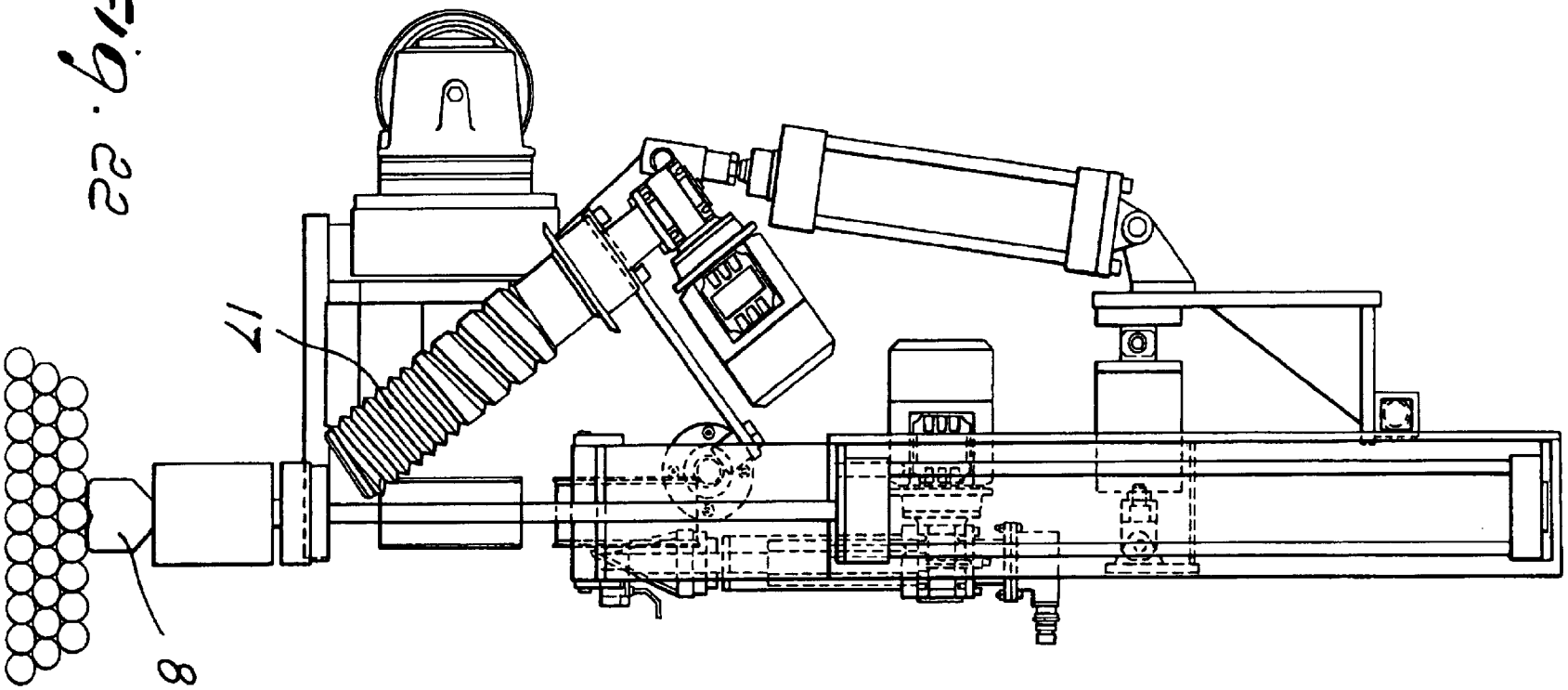

Accordingly, the grip magnet 8, actuated so as to move from the raised inactive position (see FIGS. 15 and 21) to a lowered grip position at the collection magazine 5, grips the end of the bars 2, while the screw feeder 17 is rotated in the lowered disengagement position (FIGS. 16 and 22).

Figure 17:
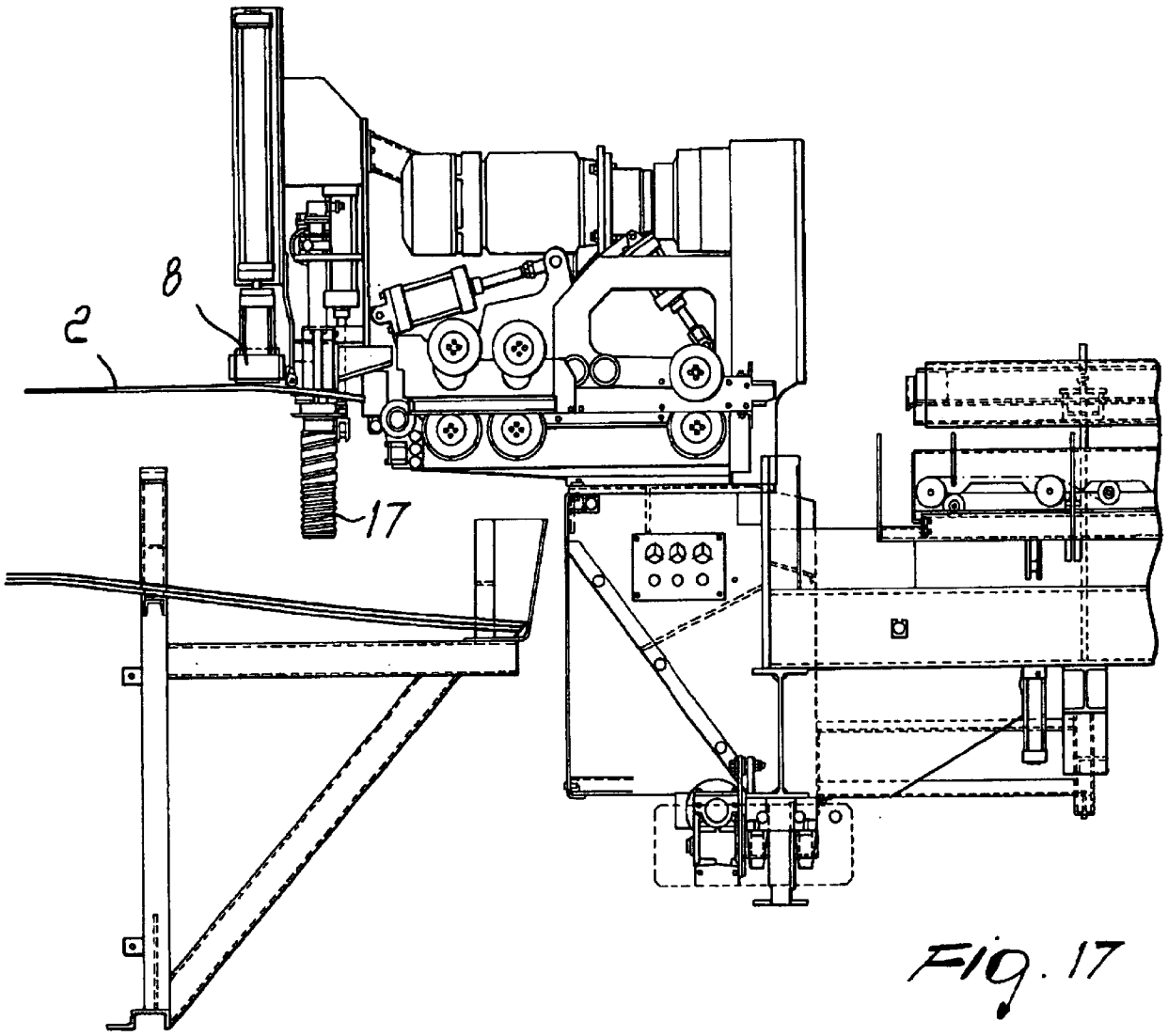
Figure 23:
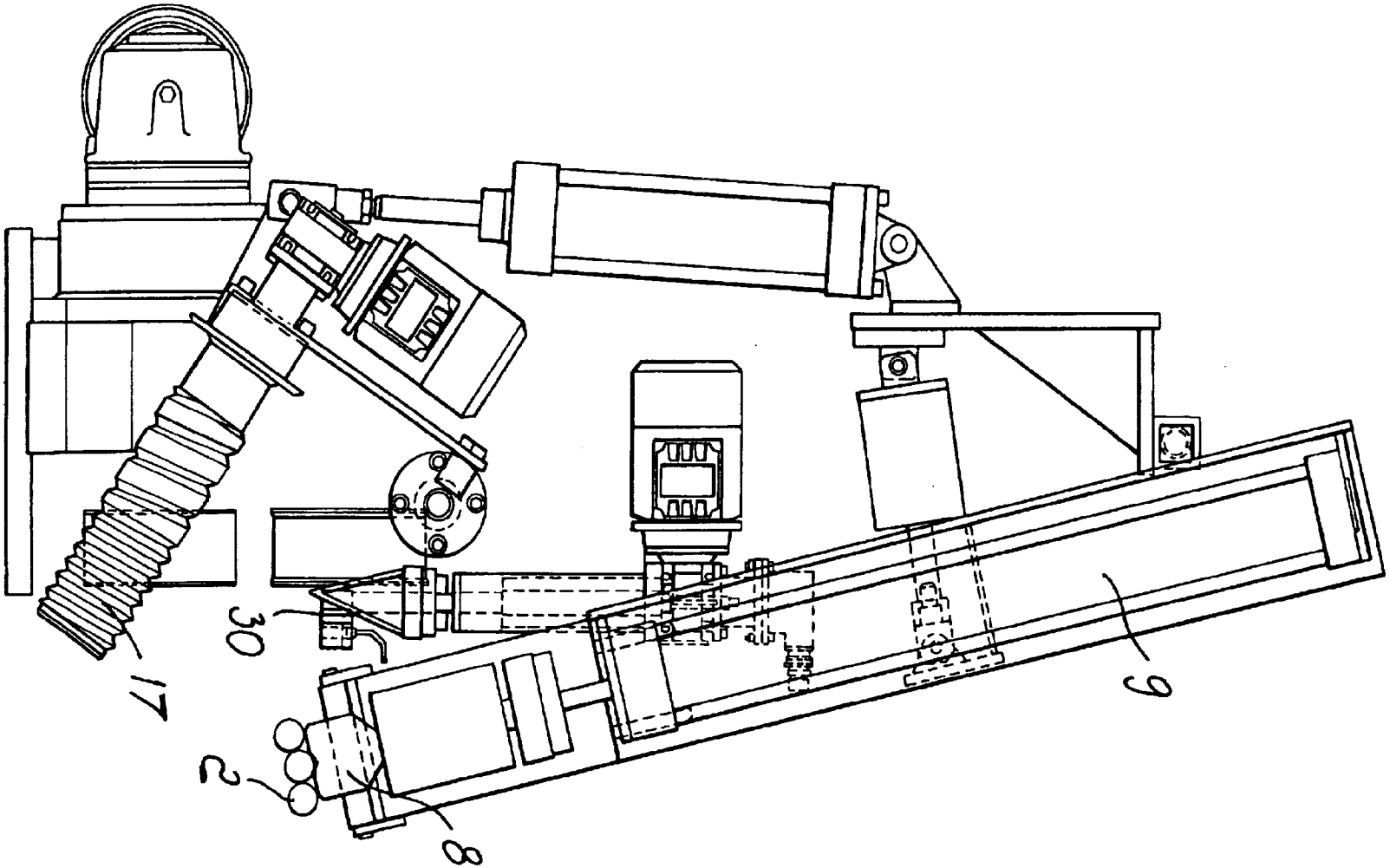

After gripping a group of bars 2, the grip magnet 8 is moved upward to support in the raised position the picked group of bars 2 (FIGS. 17 and 23). It should be noted that the jack 9 for actuating the magnet 8 is conveniently supported by a frame 22 that is mounted so as to oscillate on a pivot 23 that has a horizontal axis under the actuation of a corresponding actuator 24 in order to obtain a particular path of the ends of the bars, so as to prevent them from interfering with parts of the machine and obtain, as specified hereinafter, an aligned arrangement of the bars at the end of the counting step. The movement of the actuator 24 allows to rotate outward the frame 22 during lifting. In this position, the ends of the bars 2 are in fact not aligned with the position of the stock magazine 5, so that once they have been subjected to a translational motion due to counting, they align again with the stock magazine 5, thus avoiding unwanted lateral thrusts that would have negative repercussions on the wear of the machine.

Figure 18:
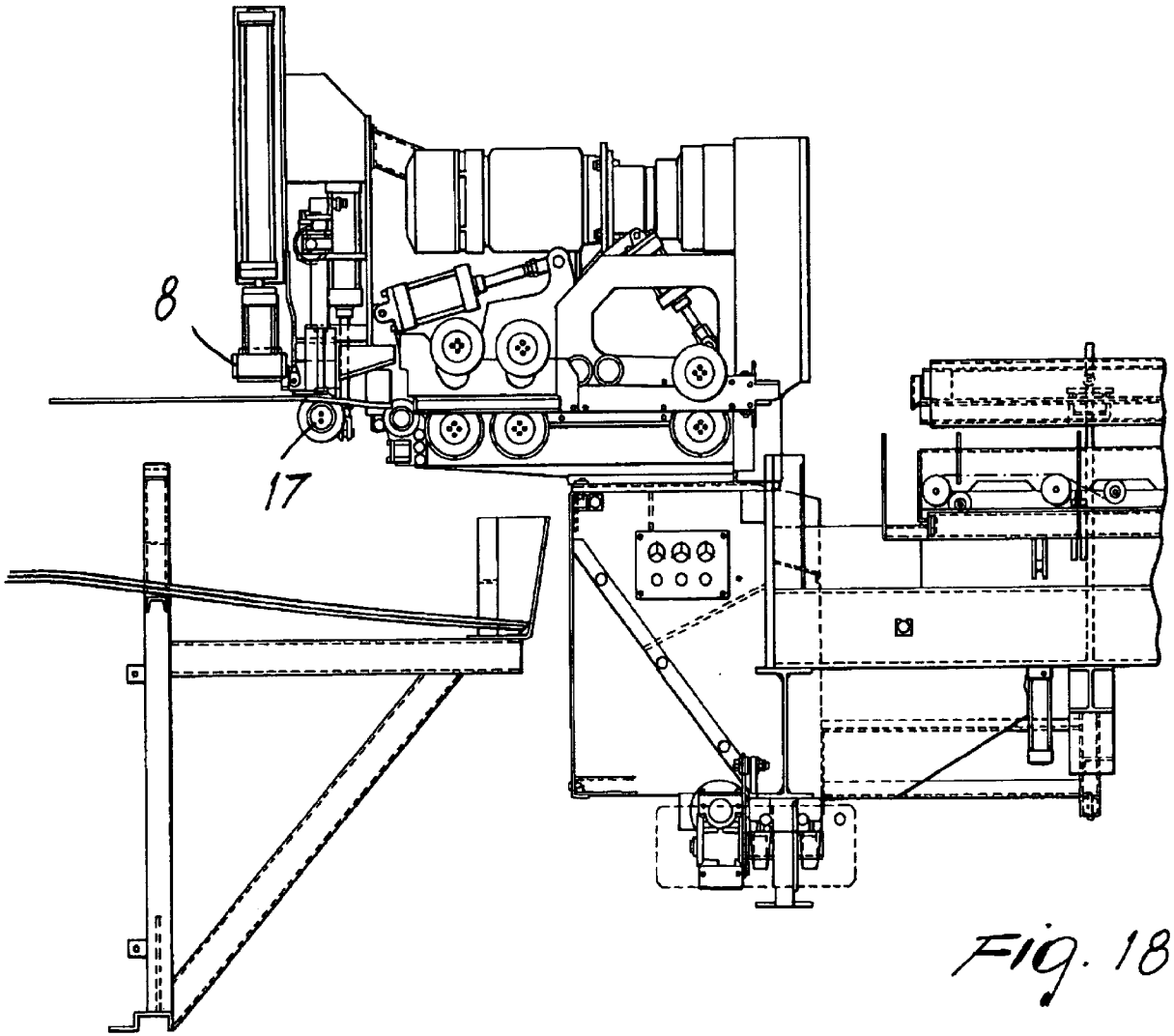
Figure 24:
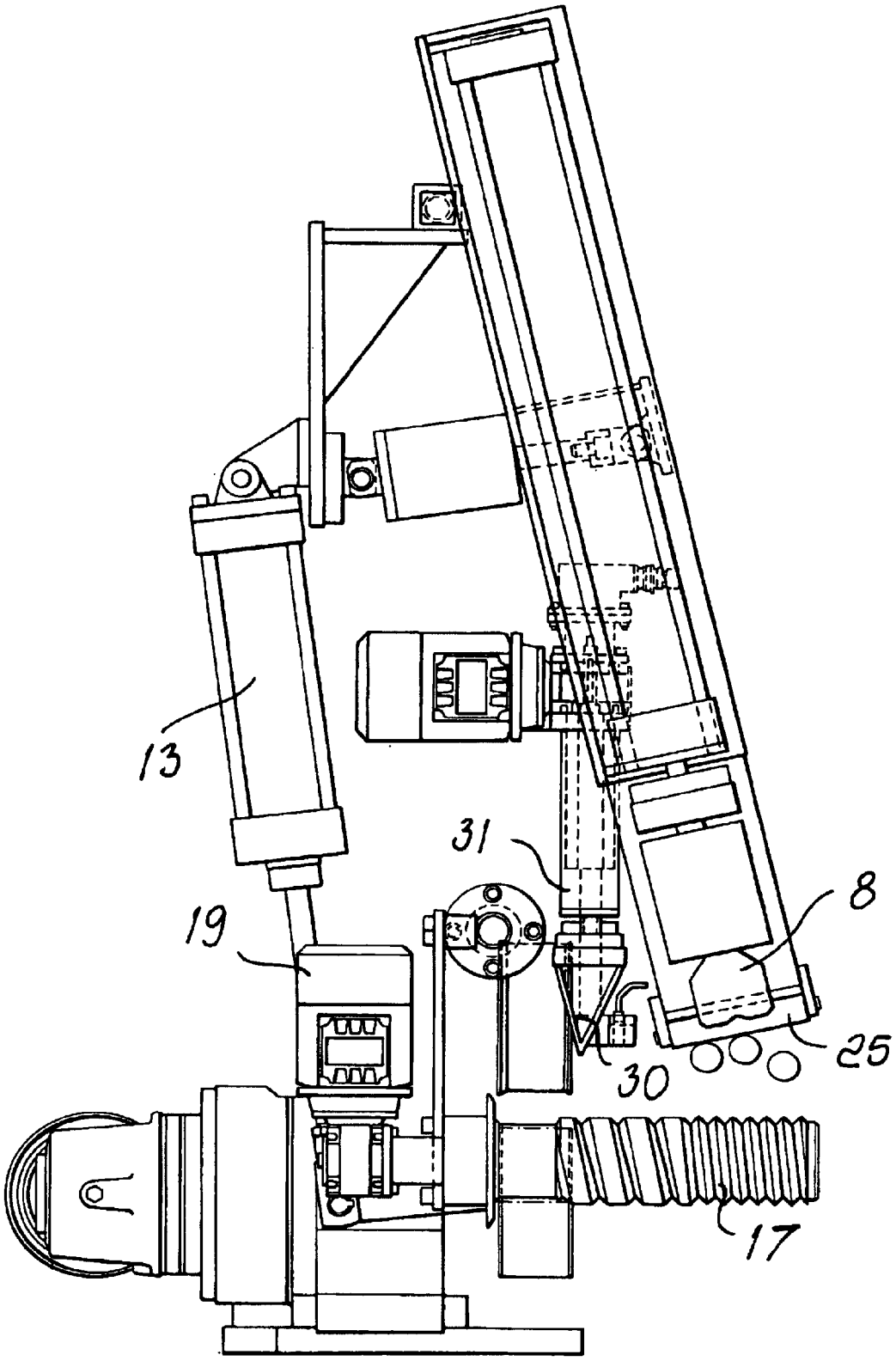

Following the lifting of the group of bars 2 by the magnet 8, the angular rotation of the screw feeder 17 into the horizontal raised position is actuated and said bars 2 are allowed to fall onto the screw feeder 17 (FIGS. 18 and 24). The separation of the bars 2 from the magnet 8 is determined by the retraction of said magnet 8, which causes the separation of the bars by continuing its stroke above a suitable fixed abutment element 25 conveniently coupled to the lower end of the frame 22 of the jack 9.

Figure 25:
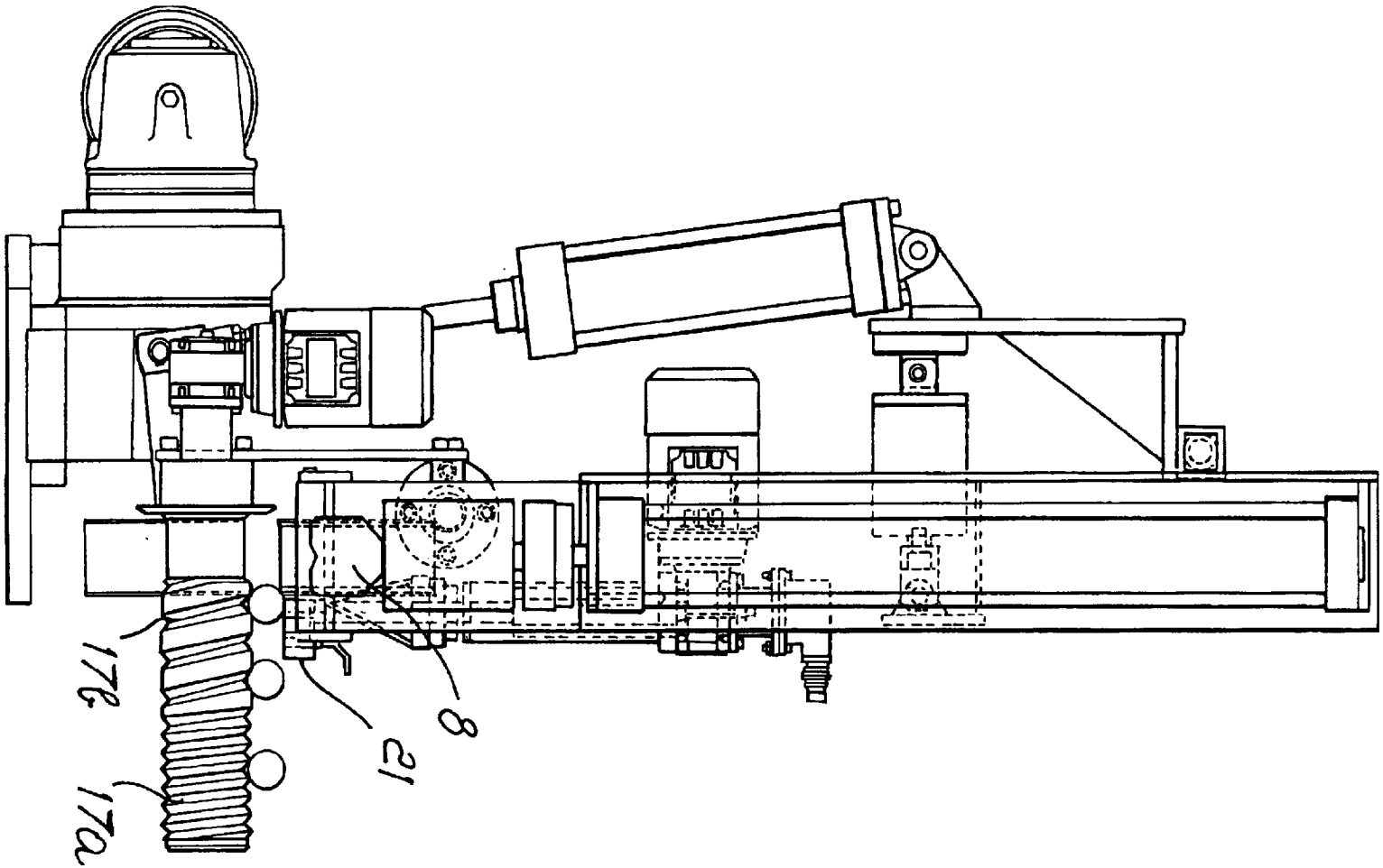

The bars 2 thus separated are deposited onto the first short-pitch portion 17*a* of the screw feeder 17, engaging individually the compartments formed by the helix. The rotation of the, screw feeder 17 determines the transfer in a transverse direction of the bars 2, which then engage the second elongated-pitch portion 17*b* of said screw feeder 17, so as to move apart uniformly (FIG. 25).

At the same time, the return of the frame 22 of the jack 9 to the vertical position is actuated.

Figure 26:
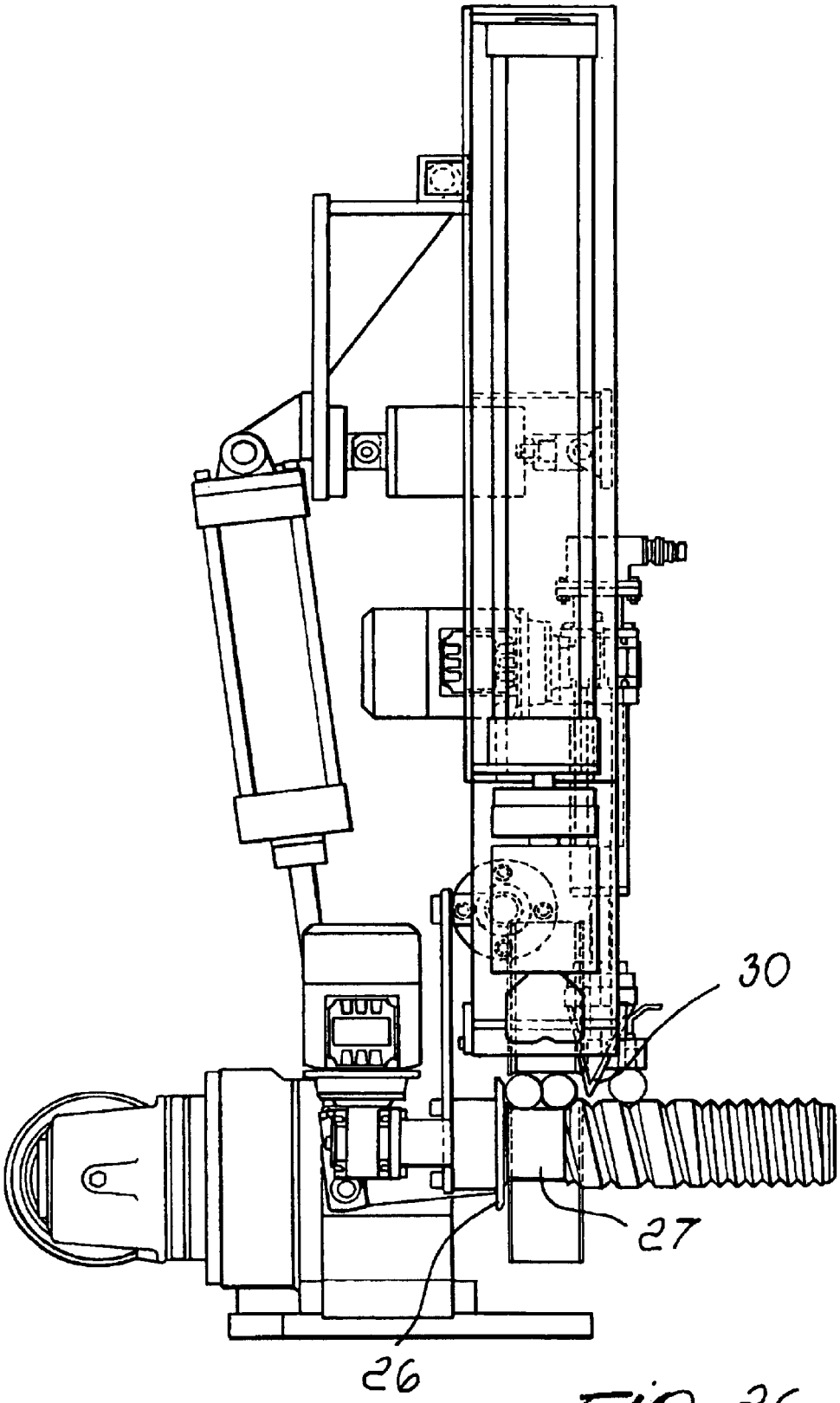

The bars 2 are transferred transversely from the screw feeder 17, leaving the elongated-pitch portion 17*b*, onto a subsequent cylindrical portion 27 that constitutes the continuation of said screw feeder 17 (FIG. 26). During said transverse transfer step, as mentioned, the bars 2 are counted by the counting means 20. The bars 2 stop in abutment against a shoulder 26 formed at the end of the cylindrical portion 27.

When a preset number of bars 2 to be fed to the machine is reached, the movement of the screw feeder 17 is halted and a suitably wedge-shaped separator 30 is actuated (see FIG. 26 again). The wedge 30 is actuated between a raised position and a lowered position, along a vertical direction, by an actuator 31. The wedge 30 ensures that the counted bars 2 remain separated from the excess bars, preventing them from being unloaded together with said excess bars in the subsequent step.

Figure 19:
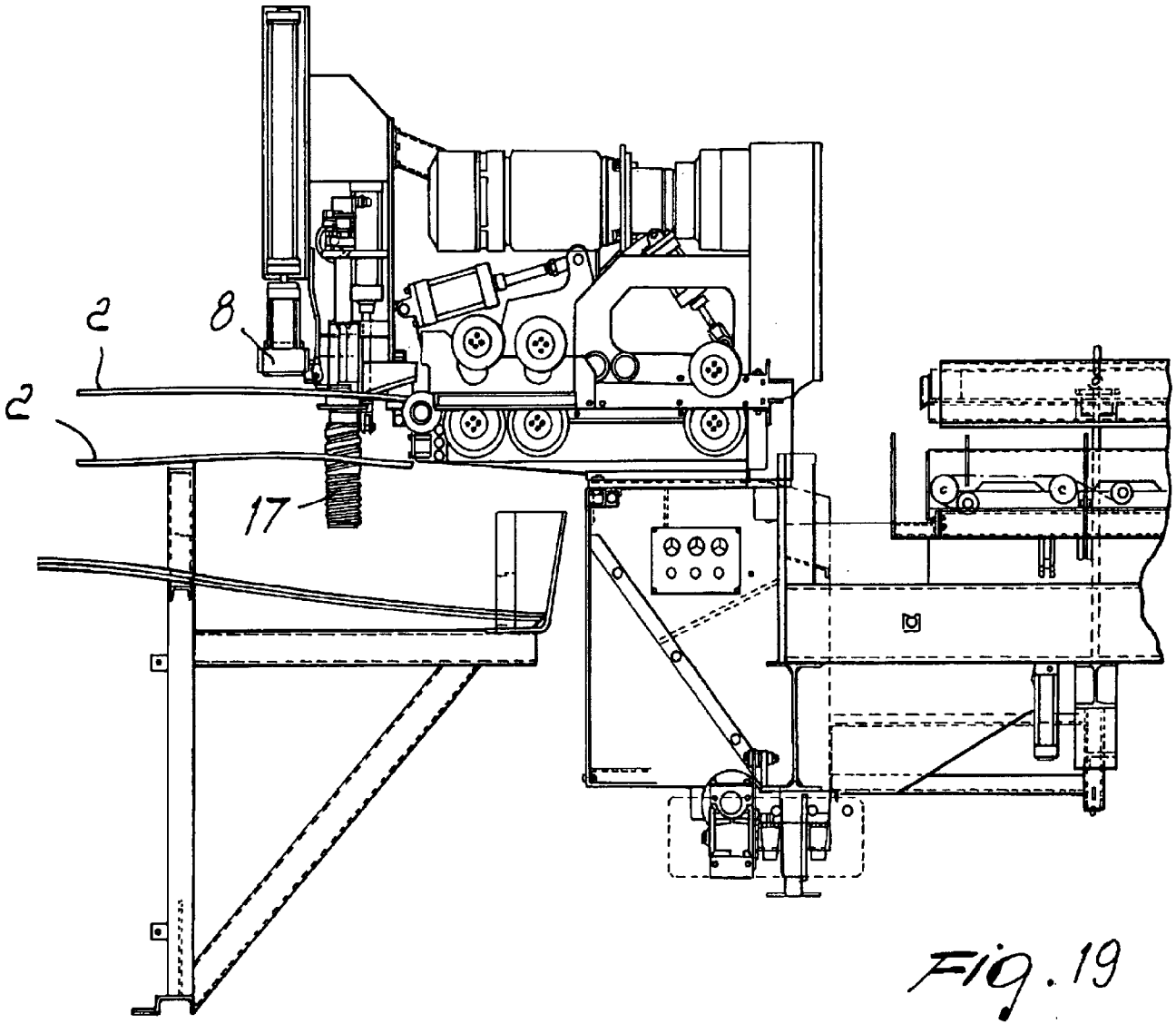
Figure 27:
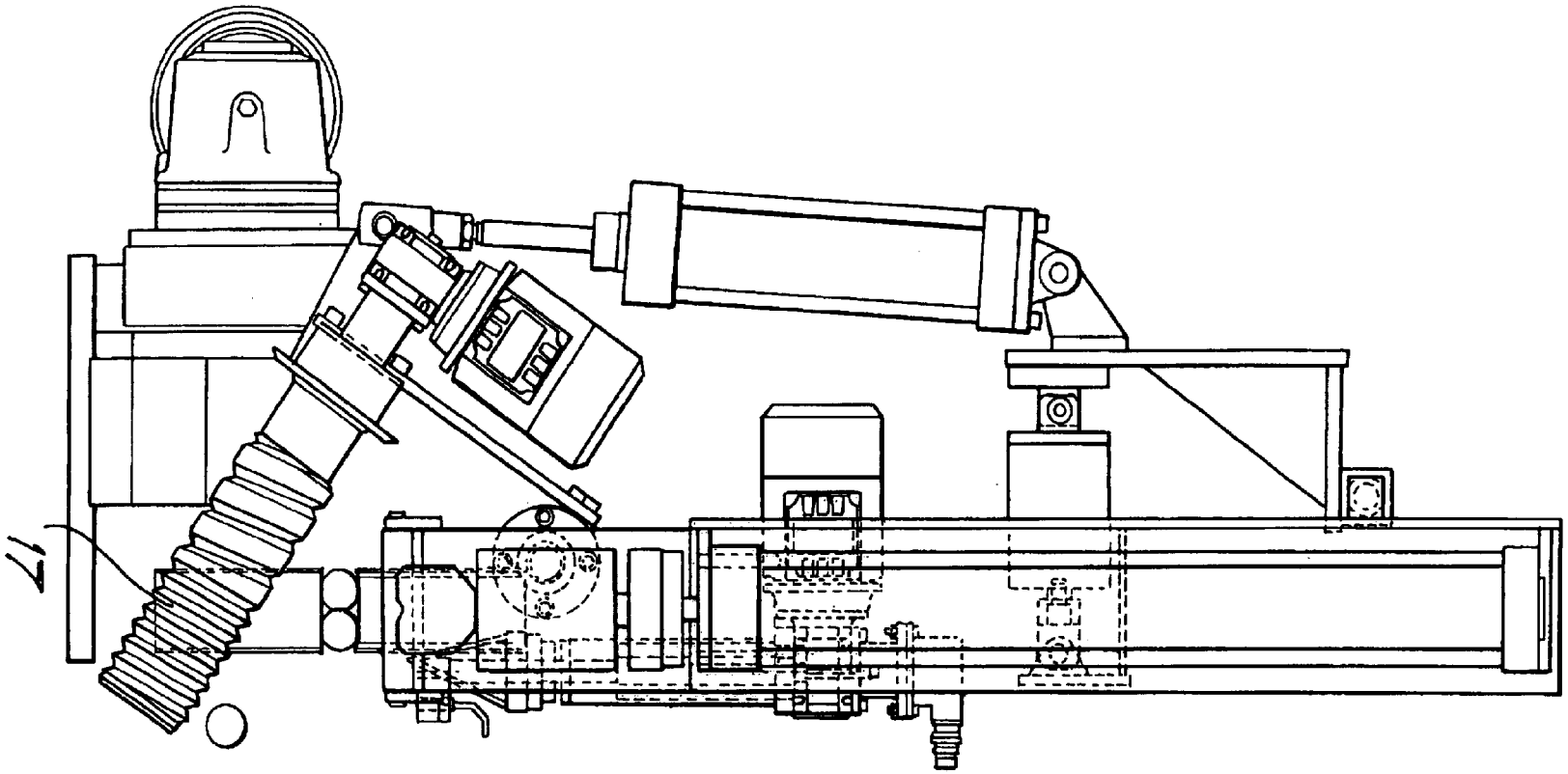

The screw feeder 17 is then rotated into the lowered position in order to unload the excess bars 2 into the same collection magazine 5 from which they had been taken (FIGS. 19 and 27). For this purpose, suitable conveyors may be provided so as to prevent the ends of the bars 2 from accidentally falling undesirably into magazines other than the one from which they came.

As mentioned, if instead the bars 2 that are present are not sufficient to reach the preset number, it is possible to repeat the described cycle until said number is reached.

Figure 20:
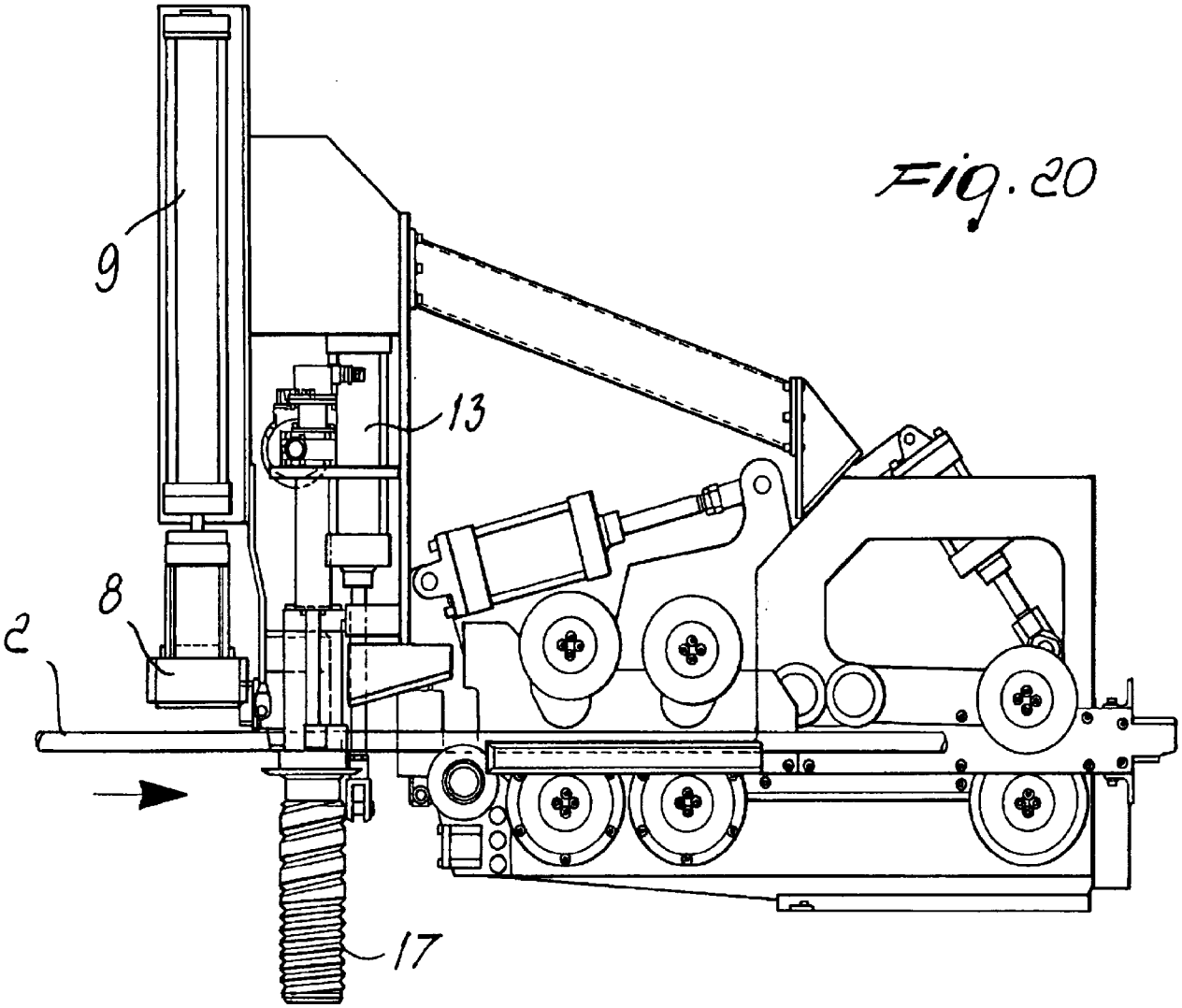

Once the preset number of bars 2 has been reached, said bars are then made to advance inside the machine, starting the working cycle of said machine (FIGS. 20 and 28). The machine is also capable of determining whether the bars 2 in the magazine or stock magazine are depleted, for example by virtue of the presence of a sensor for sensing the position of the jack that supports the grip means 8, which if there are no bars continues its stroke to its end. In this case, the cycle is suspended and a signal is issued to call the attention of an operator, who resupplies the machine or restarts the cycle, leaving on hold the working of the bars that have been depleted.

Figure 29:
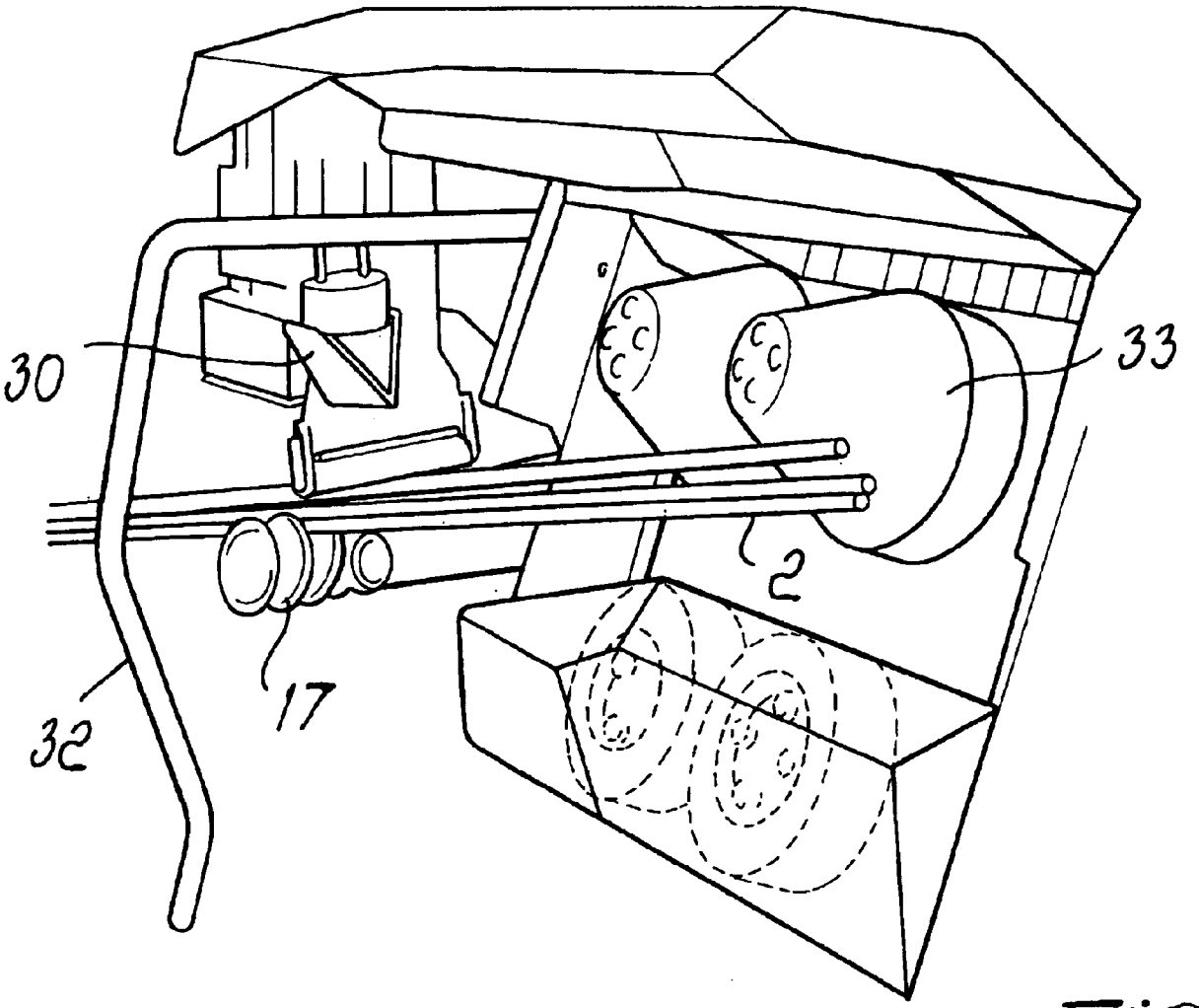
FIGS. 29, 30 and 31 are perspective views of the work area of the apparatus according to the invention in various steps of operation.
Figure 30:
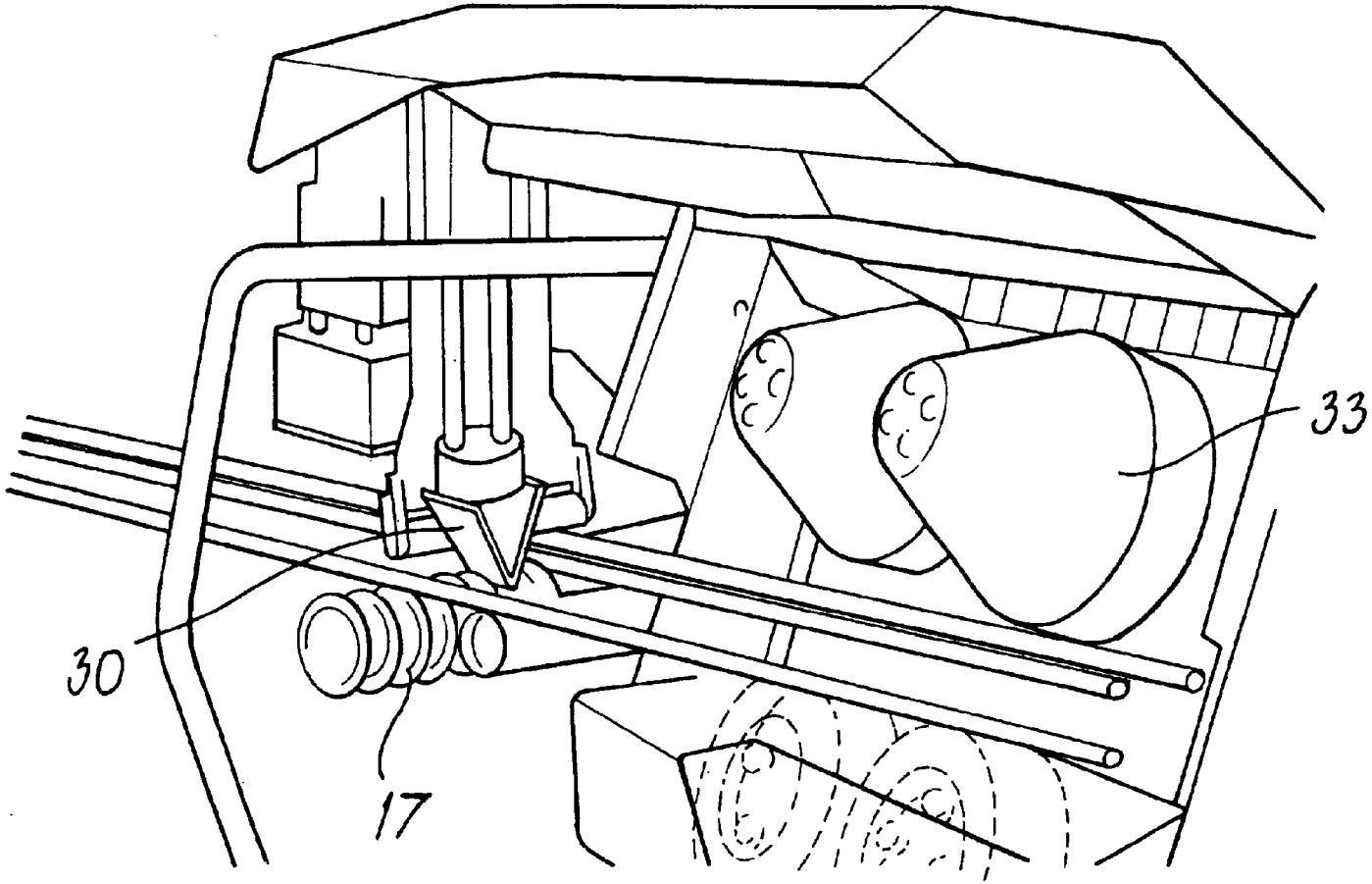
Figure 31:
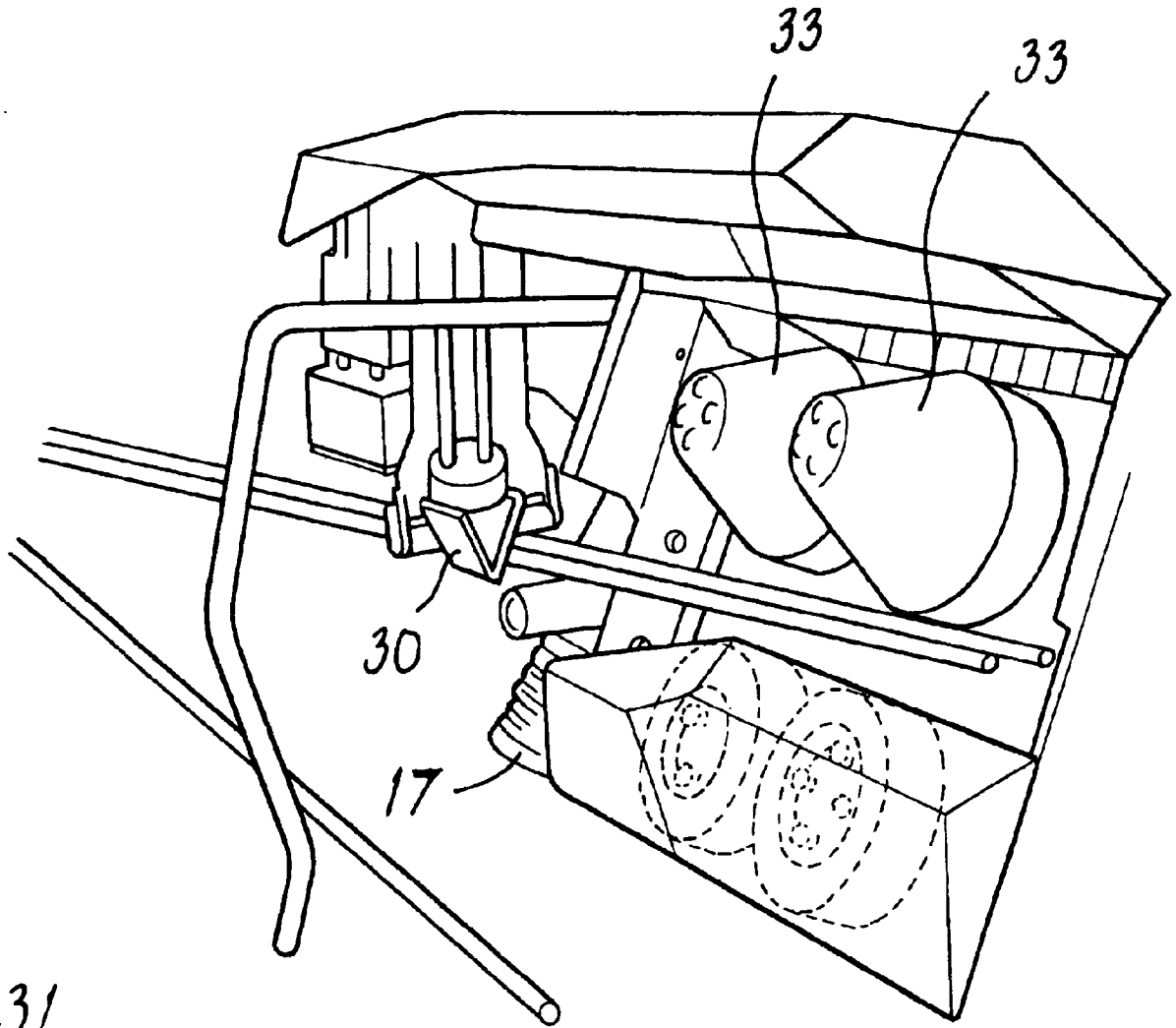

Conveniently, a conveyor 32 is used to the side of the work area of the screw feeder 17; said conveyor is suitable to prevent the unloaded excess bars 2 from falling into the wrong storage unit, as shown in FIGS. 29, 30 and 31, which illustrate sequentially the unloading step. Conveniently, conical guiding elements 33 are also used which are fitted on the transport wheels in order to facilitate the insertion of the bars 2 between said wheels.

The method and the apparatus according to the invention therefore achieve the aim of feeding automatically the metal profiles in bar form in machines for working said profiles according to the defined conditions.

Clearly, this allows to optimize the productivity of the machine in addition to freeing the operator from an unpleasant and potentially dangerous task.

It should be noted that the particular shape of the apparatus entails that the bar loading region is directed downward and has a transfer element with the screw feeder 17 supported so that it cantilevers out and can move between a raised working position and a lowered disengagement position, thus leaving said loading region clear of obstacles and allowing the direct passage of the bars 2 to be loaded from the stock magazine 5 to the machine and to then unload any excess bars simply by gravity.

Moreover, the picking of the bars performed from above by virtue of magnetic means 8 allows to grip always the bars that are arranged in the upper part of the bundle, i.e., where said bars are less entangled and therefore easier to transport. In particular, said picking action is rendered simple and low in cost by the use of a permanent magnet. The separation of the bars from the magnet 8 is achieved in a simple manner by virtue of the retraction that occurs with respect to the abutment element 25.

It should be noted that where mention has been made generically of profiles in bar form, it should be understood in any case that one of their ends is gripped and handled.

It is important to note the fact that the ends of the bars are fed from below so that their points are picked up directly by following a simple straight or substantially straight path. Accordingly, the bars do not have to travel over and past the supporting structure, as occurs for example in the solution proposed by the aforementioned Italian patent no. 1,206,893, in which the opening is directed upward and the screw feeder remains in a downward region. In the solution according to the invention, the opening is instead directed downward and the screw feeder oscillates so as to allow the passage of the bars and is arranged above the opening.

The solution according to the invention, moreover, allows to arrange the machine directly above the bundle of profiles from which the bars are picked. The machine and the magazine for storing the bars are arranged with respect to each other in the same manner in which they would be arranged if the bar feeder apparatus were not present. Therefore, the system does not require additional space.

It should be noted that the magnet picks up only a certain number of profiles in bar form and not an entire bundle.

A prerogative of the method and apparatus according to the invention is constituted by the fact that it is possible to determine the correct number of profiles to be fed to the machine at each work cycle according to the requirements of the work. Said number of profiles to be fed is preset at the beginning of the working of each, batch of profiles having uniform characteristics.

The screw feeder feeds directly the working machine arranged downstream, without interposing other components.

Preferably, a number of bars slightly higher than necessary is picked up and any excess ones are unloaded immediately when the preset number is reached, so as to be able to move the machine with respect to the various storage units of the stock magazine if it is necessary to work bars having different characteristics, which are obviously stored in different magazines, all without downtimes that would penalize productivity. If instead the number of picked bars is not sufficient, the feeding cycle can be repeated one or more times.

It should also be noted that these results are achieved by means of an apparatus that has a structure that is simple in concept, safely reliable in operation, and versatile in use.

The apparatus according to the invention can be applied to existing systems without changing the mutual arrangement of the components of the system. Moreover, it is possible to continue to work manually, if necessary, even if said apparatus is present, simply by deactivating it and leaving it in the inactive position. In practice, it is equally possible to alternate working steps in fully automatic mode and manual steps.

In the practical embodiment of the invention, the materials used, as well as the shape and the dimensions, may be any according to the requirements.

The disclosures in Italian Patent Application No. BO2002A000241 from which this application claims priority are incorporated herein by reference.

What is claimed is:

1. A method for automatic feeding of bar form metal profiles in a profile working machine, comprising the steps of:

(a). gripping a group of metal profiles in bar form from a collection magazine for collecting said profiles;

(b). transferring said group of metal profiles in bar form to a raised position;

(c). arranging said metal profiles in bar form on a transfer device provided with separating means for separating said metal profiles;

(d). transferring along a transverse direction said metal profiles in bar form, and at the same time, counting a preset number of metal profiles to be fed to the working machine at each work cycle;

(e). unloading metal profiles in excess into said collection magazine from which the profiles originate;

(f). starting automatically a normal work cycle of the working machine to perform an intended work on selected metal profiles;

(g). selectively moving with respect to each other the working machine and said collection magazine in order to pick up metal profiles from a different storage unit;

(h). starting, on request, a new work cycle.

2. The method of claim 1, wherein said step (a) for gripping a group of metal profiles in bar form from a collection magazine entails gripping, by way of grip means provided with magnetic means, profiles arranged in the upper part of the profile bundle provided in said collection magazine.

3. The method of claim 1, further comprising gripping said group of metal profiles in bar form by way of grip means provided with magnetic means constituted by a permanent magnet and separating said profiles from said magnetic means, in said raised position, in order to arrange said profiles on said transfer device, by way of a relative retraction with respect to abutment means provided at said grip means.

4. The method of claim 1, comprising carrying out repeatedly feeding cycles for feeding of profile groups in bar form until said preset number of metal profiles to be fed to the machine is reached, before starting said work cycle of the machine.

5. The method of claim 1, comprising performing said step (e) for unloading the excess metal profiles in masked time, during said work cycle of the machine.

6. The method of claim 1, comprising performing said step (e) for unloading the excess metal profiles by gravity, clearing a passage region from said separation means, which remain inactive during said unloading step.

7. The method of claim 1, wherein said work cycle of the working machine comprises producing a relative movement of said working machine with respect to said collection magazine for collecting said profiles in order to pick up said profiles from different storage units of the same collection magazine.

8. An apparatus for automatic feeding of bar form metal profiles in profile working machines, comprising: a collection magazine for collecting said profiles; profile receiving elements, provided at the working machine; grip means for gripping a group of metal profiles in bar form from said collection magazine and transferring said group of metal profiles in bar form to a raised position; a transfer device, for receiving said group of metal profiles in bar form from said grip means and conveying said profiles toward said profile receiving elements of the machine; separation means which are associated with said transfer device to produce transfer of said profiles in a transverse direction with the profiles in a uniformly spaced arrangement; counting means for counting a preset number of metal profiles to be fed to the working machine at each work cycle.

9. An apparatus for automatic feeding of bar form metal profiles in profile working machines, comprising: a profile collection magazine; a shaft; a motor, mounted on a frame of said apparatus, to actuate said shaft; profile receiving elements, provided at the working machine; grip means for gripping a group of metal profiles in bar form from said collection magazine and to transfer said group of metal profiles in bar form to a raised position; a screw feeder for receiving said group of metal profiles in bar form from said grip means and mounted so as to rotate on said shaft to transfer transversely said metal profiles, in a uniformly spaced arrangement, toward said receiving elements, counting means for counting a preset number of metal profiles to be fed to the working machine at each work cycle.

10. The apparatus of claim 9, wherein said grip means comprise magnetic means movable along a vertical axis, and an actuator for moving said magnetic means.

11. The apparatus of claim 9, wherein said collection magazine comprises at least one profiled compartment, said grip means comprising magnetic means and an actuator for moving said magnetic means along a path defined according to physical dimensions of a cutting head of the working machine and dimensions of said at least one compartment of the collection magazine, and so as to allow a same mutual arrangement of the working machine with respect to said collection magazine that said working machine would assume if the apparatus were arranged away therefrom.

12. The apparatus of claim 11, wherein said magnetic means comprise a permanent magnet.

13. The apparatus of claim 10, comprising: actuation means, a frame for supporting said magnetic means that is mounted so as to oscillate about a horizontal axis of the apparatus; frame actuation means for actuating said frame, so as to rotate through an angle said magnetic means for transferring a group of metal profiles in bar form in a raised position to avoid interference of said profiles with parts of the machine and to align said profiles with respect to said collection magazine upon counting said profiles.

14. The apparatus of claim 8, wherein said transfer device comprises a screw feeder that is oscillatable between a substantially horizontal raised working position and a lowered disengagement position.

15. The apparatus of claim 14, comprising: an actuator of the transfer device; an assembly that is oscillatable with a reciprocating motion about a horizontal axis of the apparatus under actuation of said actuator of the transfer device, said screw feeder being supported so as to cantilever out by said assembly for moving so as to clear a region where the bar profiles are made to pass.

16. The apparatus of claim 15, wherein said screw feeder has a variable pitch, with a first short-pitch portion and a second elongated-pitch portion.

17. The apparatus of claim 16, wherein said screw feeder comprises a cylindrical portion onto which a preset number of metal profiles to be fed to the machine is transferred.

18. The apparatus of claim 9, having a structure that is open in a downward region thereof to allow direct passage of said metal profiles and unloading of the profiles by gravity.

19. The apparatus of claim 9, further comprising a separator which is actuatable between a raised position and a lowered position, along a substantially vertical direction, in order to separate counted metal profiles to be transferred in a preset number to the working machine and excess profiles.

20. The apparatus of claim 19, wherein said separator is wedge-shaped.

21. The apparatus of claim 8, wherein said separation means comprise: a shaft; a motor, supported by said transfer device for turning said shaft; and a screw feeder which is mounted so as to rotate on said shaft.

22. The apparatus of claim 8, wherein said grip means have an abutment that is arrangeable in vertically adjustable portions to prevent said transfer device from conveying overlapping metal profiles.

* * * * *